US008292144B2

(12) United States Patent
Maltais et al.

(10) Patent No.: US 8,292,144 B2
(45) Date of Patent: Oct. 23, 2012

(54) NAILER WITH CONTROLLED ACTION FEEDER MAGAZINE ASSEMBLY

(75) Inventors: Jacques Maltais, Quebec (CA); Maxime Dupont, Quebec (CA); David Lavoie, Quebec (CA)

(73) Assignee: Laboratoire Primatech Inc., Quebec, Quebec (CA)

( * ) Notice: Subject to any disclaimer, the term of this patent is extended or adjusted under 35 U.S.C. 154(b) by 22 days.

(21) Appl. No.: 12/828,711

(22) Filed: Jul. 1, 2010

(65) Prior Publication Data

US 2011/0006098 A1 Jan. 13, 2011

Related U.S. Application Data

(60) Provisional application No. 61/213,771, filed on Jul. 13, 2009.

(51) Int. Cl.
*B25C 5/06* (2006.01)

(52) U.S. Cl. ..... 227/126; 227/125; 227/120; 227/130

(58) Field of Classification Search ..... 227/107, 227/120, 125, 126, 135, 136
See application file for complete search history.

(56) References Cited

U.S. PATENT DOCUMENTS 5,628,445 A * 5/1997 Braddock et al. ..... 227/151
6,024,268 A * 2/2000 Horng-Lin ..... 227/120
6,027,004 A * 2/2000 Ramella et al. ..... 227/136
6,032,848 A * 3/2000 Smolinski ..... 227/136
6,123,245 A 9/2000 Maltais
6,145,725 A * 11/2000 Omli ..... 227/18
6,161,744 A * 12/2000 Mukoyama et al. ..... 227/8
6,290,115 B1 * 9/2001 Chen ..... 227/120
6,595,399 B1 * 7/2003 Cassese ..... 227/120
6,824,036 B2 * 11/2004 Walter ..... 227/120
6,938,809 B1 * 9/2005 Schnell ..... 227/8
2009/0050668 A1 * 2/2009 Jian ..... 227/126
2009/0134195 A1 * 5/2009 Wojcicki ..... 227/120

* cited by examiner

*Primary Examiner* — Rinaldi Rada
*Assistant Examiner* — Eyamindae Jallow
(74) *Attorney, Agent, or Firm* — Fraser Clemens Martin & Miller LLC; J. Douglas Miller

(57) ABSTRACT

The pneumatic nailer has an elbowed feeder magazine for feeding fasteners one at a time. The magazine has an elongated inner frame segment fixedly mounted to the nailer main frame, an elongated outer frame segment operatively connected in non-coaxial fashion to the inner frame segment. Each of the inner and outer frame segments has a corresponding first and second channels, for slidingly retaining fasteners in coextensive slidethrough fashion. The fasteners are movable under gravity forces from a fastener intake to a fastener discharge outlet opposite the fastener intake. A fastener pusher device may be provided with a pusher retention device having an operative mode, active with a large storage load of fasteners into the magazine, and an inoperative mode, triggered when the load of magazine fasteners decreases below a threshold value.

13 Claims, 36 Drawing Sheets

NAILER WITH CONTROLLED ACTION FEEDER MAGAZINE ASSEMBLY

CROSS-REFERENCE DATA

The present application claims the priority of U.S. provisional patent application No. 61/213,771 filed on Jul. 13, 2009.

FIELD OF THE INVENTION

This invention relates to pneumatic, electrical or manual tools adapted to anchor fasteners on floor or wall surfaces, and in particular to a controlled action feed mechanism of these anchor fasteners from their storage strip fasteners magazine location to their fastener ejection channel location where they are transversely struck by the ejection striking rod one at a time.

BACKGROUND OF THE INVENTION

Hardwood flooring generally consists of a number of juxtaposed elongated tongue-and-groove planks P (FIG. 1) interlocked with each other, and then fastened in position to a subjacent subfloor S. To fasten these hardwood planks P to the subfloor S of a room (composed for example of plywood plates and/or floor joists), it is known to use a dedicated pneumatic nailer N, N', N" (FIGS. 1-3). A pneumatic nailer for hardwood flooring generally comprises a main frame carrying a floor-engageable shoe H mounted to its bottom surface, upon which the nailer rests against a hardwood plank prior to discharging a fastener in the latter.

The pneumatic nailer also comprises an actuator housing on the nailer's main body and connected to a pressurized air source (e.g. an air compressor). The actuator housing has a casing defining a pressurized air chamber therein, the casing carrying a fastener discharge mechanism comprising an actuator head and a piston assembly. The piston assembly comprises a cylinder defining a cylinder chamber, and a plunger mounted inside the cylinder chamber and movable therein between upper and lower limit positions. The plunger in turn comprises a head portion engaging the inner peripheral wall of the cylinder in airtight fashion, and a striking rod carried by the plunger head.

At rest, a valve of the actuator head is positioned in a closed position, in which it cuts off fluid communication between the upper portion of the piston's cylinder chamber (the portion located above the plunger head) and the pressurized air chamber. To conventionally set off a fastener discharge cycle of the nailer, a workman activates a trigger thereof, which causes the valve to shift to its open position and to enable air to be admitted in the piston's cylinder above of the plunger head, which causes the plunger to move with great force and celerity from its upper limit position to its bottom limit position. As the plunger travels from its upper to its bottom limit position, the striking rod thereof sweeps the fastener ejection channel containing a fastener. The fastener is consequently forced out of the nailer and driven into the subjacent workpiece.

Moreover, a magazine M (M', M") is usually mounted to the nailer and serially feeds fasteners, grouped in a strip of successive fasteners with frangible interconnection between each successive pair of fasteners, and each fastener individually in the form of metallic L- or T-shaped barbed cleats or staples, one at a time into a fastener ejection channel defined by the actuator housing and proximate bottom shoe H.

Current state of the art fastener strips number is 100 fasteners, for 16 ga nails, 120 fasteners for 18 ga nails, and 46 fasteners for staples. The size and shape of the fasteners must be compatible with the structure of the storage chamber inside the magazine. Inside the magazine, there is a linear blade biasing means to bias the leading fastener from the strip of fasteners toward the strike channel. Usually, as shown in FIG. 1, magazine M is straight and extends in upwardly outwardly inclined fashion relative to a vertical plane intersecting the nailer shoe H in the nailer operative condition, and perpendicular to the fastener ejection channel.

Simply extending the length of a fastener magazine M to load additional fasteners has a number of drawbacks, including:

- it keeps the tool N away from the work area due to its size;
- it brings improper center of gravity shift problems;
- it increases minimum horizontal clearance values, thus preventing a nailer operator to nail several rows of wooden planks close to an upright wall W (FIG. 1) which would otherwise have been nailed;
- a nailer N is designed in such a way that by lifting its top handle D, the bottom shoe H and the fastener ejection point all take their operative positions; this is not possible when a nailer fastener magazine M is of greater length, since the operator must then provide constant wrist rotational torque to compensate unbalanced center of gravity and to provide suitable tool positioning, thus bringing muscular fatigue to the operator.

In conventional fastener nailers (illustrated in FIGS. 1-3), the magazine M must always be longer than the total length of the combined load of multiple fastener strips engaged in the magazine channel. Moreover, a further drawback of conventional fastener pushers U (FIGS. 8-10) is that they are not adapted to operate in an elbowed magazine channel environment.

One could operate without pusher U, and let fasteners be fed by gravity. However, typically, one problem with gravity feeding of fasteners in a nailer magazine M, M', M", is the jamming that occurs when only a few fasteners remain in the magazine.

SUMMARY OF THE INVENTION

The invention relates to controlled action feeder magazine assembly for feeding a strip of multiple fasteners into a pneumatic nailer, the nailer having a main frame with a fastener discharge outlet to which said magazine assembly is to be mounted, the magazine assembly having an elongated inner frame segment to be fixedly mounted to the nailer main frame, an elongated outer frame segment, and coupling means operatively connecting in non-coaxial fashion said outer and inner frame segments in an elbowed fashion for free slidethrough of the strip of fasteners, each of said inner frame segment and outer frame segment having a corresponding first and second channels for slidingly retaining fasteners in slidethrough fashion, the fasteners movable under gravity forces through said frame segment channels from a fastener intake means to a fastener discharge means thereof opposite said fastener intake means.

Preferably, there is added a spring biased fastener pusher means, carried inside said magazine inner frame segment, said fastener pusher means for forcibly biasing the fasteners toward said fastener discharge means, and a pusher means retention means, said retention means having an operative mode, active with a large storage load of fasteners into said channel of inner magazine frame segment, and an inoperative mode, triggered when the load of fasteners in said inner magazine frame segment decreases below a threshold value.

Preferably, said pusher means includes a carriage slidably carried into said magazine inner frame segment with said carriage including a notch and said retention means includes an elongated rigid lock tab endwisely pivotally mounted at an intermediate first pivot mount to said magazine inner frame segment at said fastener intake means, wherein one and another tab end portions are defined on opposite sides of said first pivot mount, said another tab end portion including an intermediate transversely projecting ear releasably engaged into said carriage notch in said fastener pusher means operative mode; and said ear disengaged from said carriage notch in said fastener pusher means inoperative mode, said inoperative mode being induced by fastener depletion-based tilt release of said another tab end portion about said first pivot mount. Said lock tab may be made from a metallic material.

In one embodiment, said pusher means could include a carriage slidably carried into said magazine inner frame segment and having a transverse leg, and said retention means includes an ear integrally projecting from opposite side walls defined by said channel within said magazine inner frame segment, said ear releasably abutting against said carriage transverse leg in said operative mode of said retention means, and said ear disengaging said carriage transverse leg in said inoperative mode thereof, said inoperative mode being induced by fastener depletion-based release of said carriage transverse leg from said ear.

Alternately, said pusher means could include a carriage slidably carried into said magazine inner frame segment and defining a carriage frame seat, said retention means including an arcuate retention lever having first and second opposite legs, said first leg having an elbowed free end portion releasably abutting against said fastener pusher frame seat in said operative mode of said retention means and releasing said pusher frame seat in said inoperative mode thereof, said retention lever extending on an exterior side of said magazine inner frame segment except for said elbowed free end portion of said first leg which extends transversely through an intermediate section of a side wall defined by said magazine inner frame segment, a pivotal axle also mounted exteriorly of said magazine inner frame segment and rotatably journaled thereto and pivotally mounting an intermediate elbow apex of said arcuate retention lever to said magazine inner frame segment, a roller pivotally mounted to said retention lever second leg, said roller for rollingly releasable engagement with a top edge side of the fastener strip in said operative mode of said retention means, and clearing the top edge side of fastener strip in said inoperative mode of said retention means under fastener depletion-based counterclockwise rotation of said arcuate retention lever about said pivotal axle thereof.

The invention also relates to a controlled action feeder magazine assembly for feeding a strip of multiple fasteners into a pneumatic nailer, the nailer having a main frame with a fastener discharge outlet to which said feeder magazine assembly is to be mounted, said magazine assembly including a channel member to be fixedly mounted to the nailer main frame for free slidethrough of the strip of fasteners and for slidingly retaining fasteners in slidethrough fashion, the fasteners movable under gravity forces through said channel member from a fastener intake means thereof to a fastener discharge means thereof opposite said fastener intake means; a spring biased fastener pusher means carried inside said channel member, said fastener pusher means for forcibly biasing the fasteners toward said fastener discharge means, and a pusher means retention means, said retention means having an operative mode, active with a large storage load of fasteners into said channel member, and an inoperative mode, triggered when the load of fasteners in said channel member decreases below a threshold value.

Preferably, said pusher means would then include a carriage slidably carried into said channel member with said carriage including a notch and said retention means including an elongated rigid lock tab endwisely pivotally mounted at an intermediate first pivot mount to said channel member at said fastener intake means, wherein one and another tab end portions are defined on opposite sides of said first pivot mount, said another tab end portion including an intermediate transversely projecting ear releasably engaged into said carriage notch in said fastener pusher means operative mode; and said ear disengaged from said carriage notch in said fastener pusher means inoperative mode, said inoperative mode being induced by fastener depletion-based tilt release of said another tab end portion about said first pivot mount. Said lock tab is made from a metallic material.

Alternately, said pusher means could include a carriage slidably carried into said channel member and having a transverse leg, and said retention means includes an ear integrally projecting from opposite side walls defined by said channel members therewithin, said ear releasably abutting against said carriage transverse leg in said operative mode of said retention means, and said ear disengaging said carriage transverse leg in said inoperative mode thereof, said inoperative mode being induced by fastener depletion-based release of said carriage transverse leg from said ear.

Still alternately, said pusher means would include a carriage slidably carried into said channel member and defining a carriage frame seat, said retention means including an arcuate retention lever having first and second opposite legs, said first leg having an elbowed free end portion releasably abutting against said fastener pusher frame seat in said operative mode of said retention means and releasing said pusher frame seat in said inoperative mode thereof, said retention lever extending on an exterior side of said channel member except for said elbowed free end portion of said first leg which extends transversely through an intermediate section of a side wall defined by said channel member, a pivotal axle also mounted exteriorly of said channel member and rotatably journaled thereto and pivotally mounting an intermediate elbow apex of said arcuate retention lever to said channel member, a roller pivotally mounted to said retention lever second leg, said roller for rollingly releasable engagement with a top edge side of the fasteners strip in said operative mode of said retention means, and clearing the top edge side of fasteners strip in said inoperative mode of said retention means under fastener depletion-based counterclockwise rotation of said arcuate retention lever about said pivotal axle thereof.

DETAILED DESCRIPTION OF THE EMBODIMENTS

Figure 1:
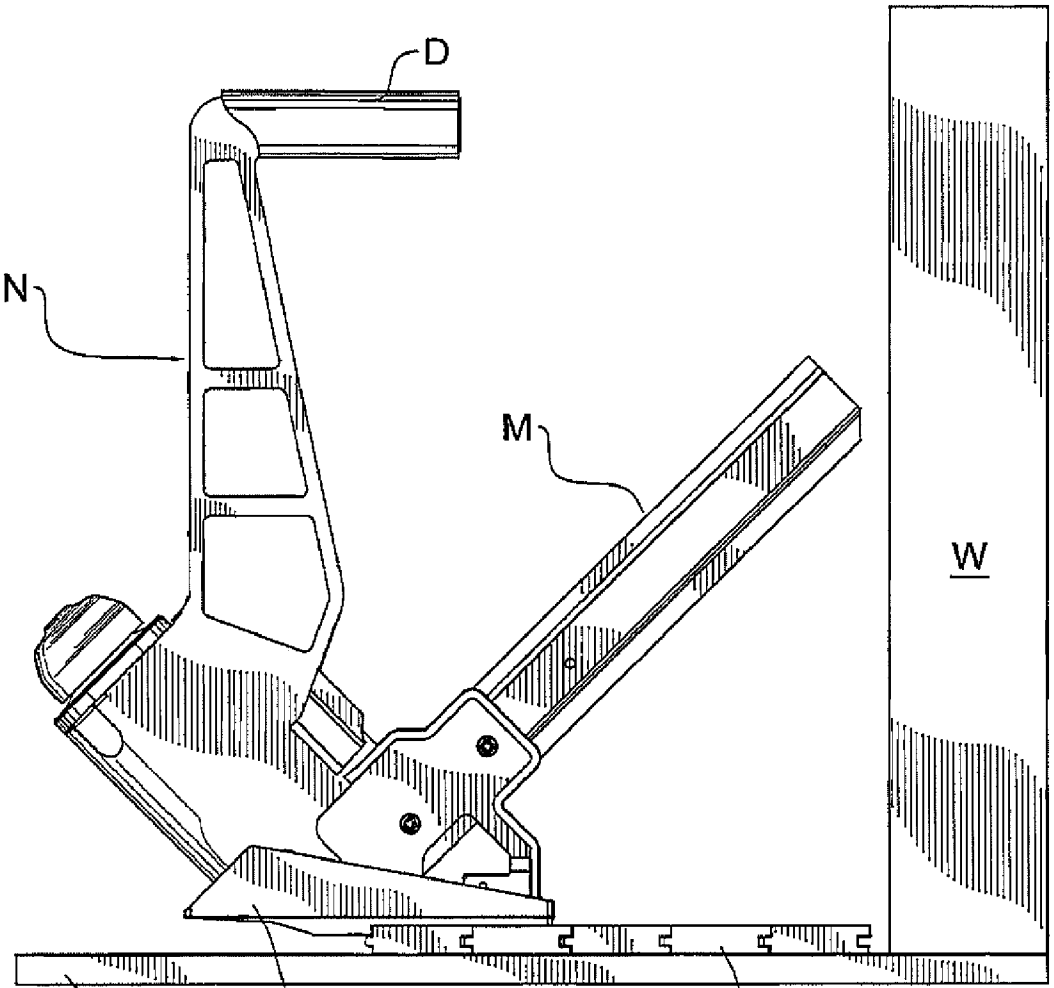
PRIOR ART Fig. 1
FIG. 1 is an elevational view of a prior art nailer with outwardly rearwardly diverging elongated straight fastener feeder magazine, standing upright over a floor and at a short distance from an upright wall.
Figure 2:
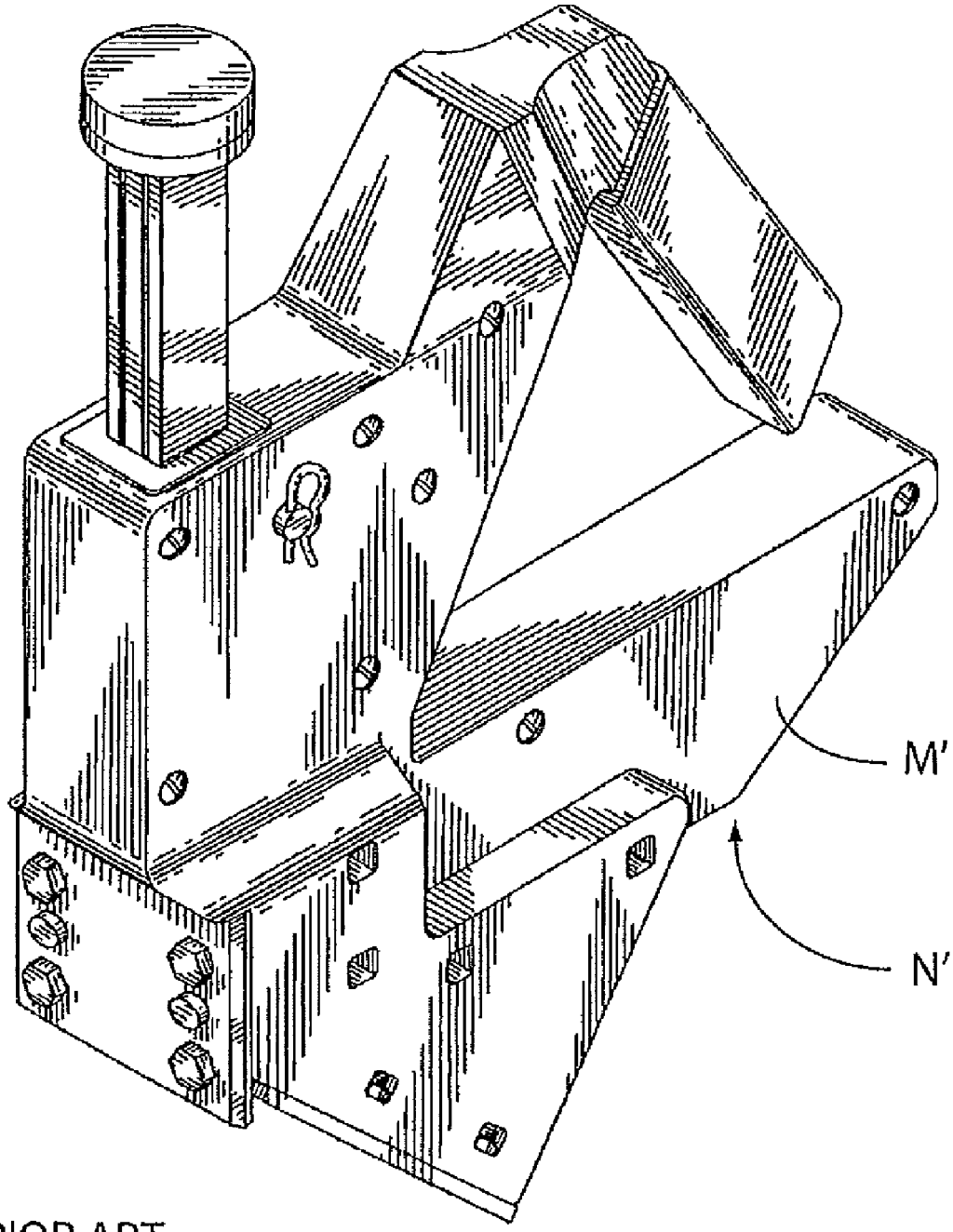
PRIOR ART Fig 2
FIG. 2 is a perspective view of an alternate embodiment of prior art nailer with arcuate handle and horizontally extending fastener feeder magazine.
Figure 3:
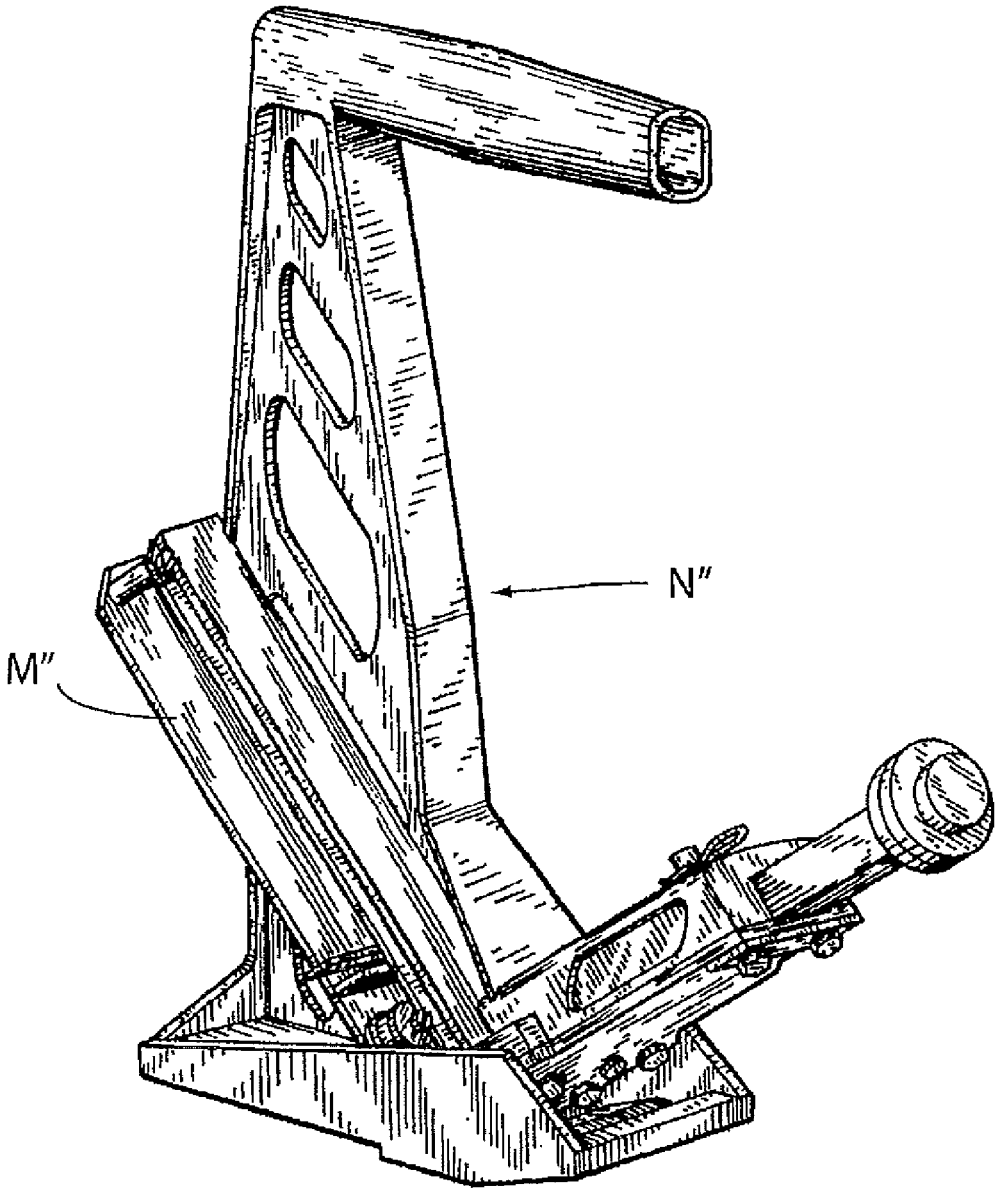
PRIOR ART Fig 3
FIG. 3 is a perspective view of still another alternate embodiment of prior art nailer having an upright front handle and an outwardly forwardly diverging elongated straight fastener feeder magazine.
Figure 4:
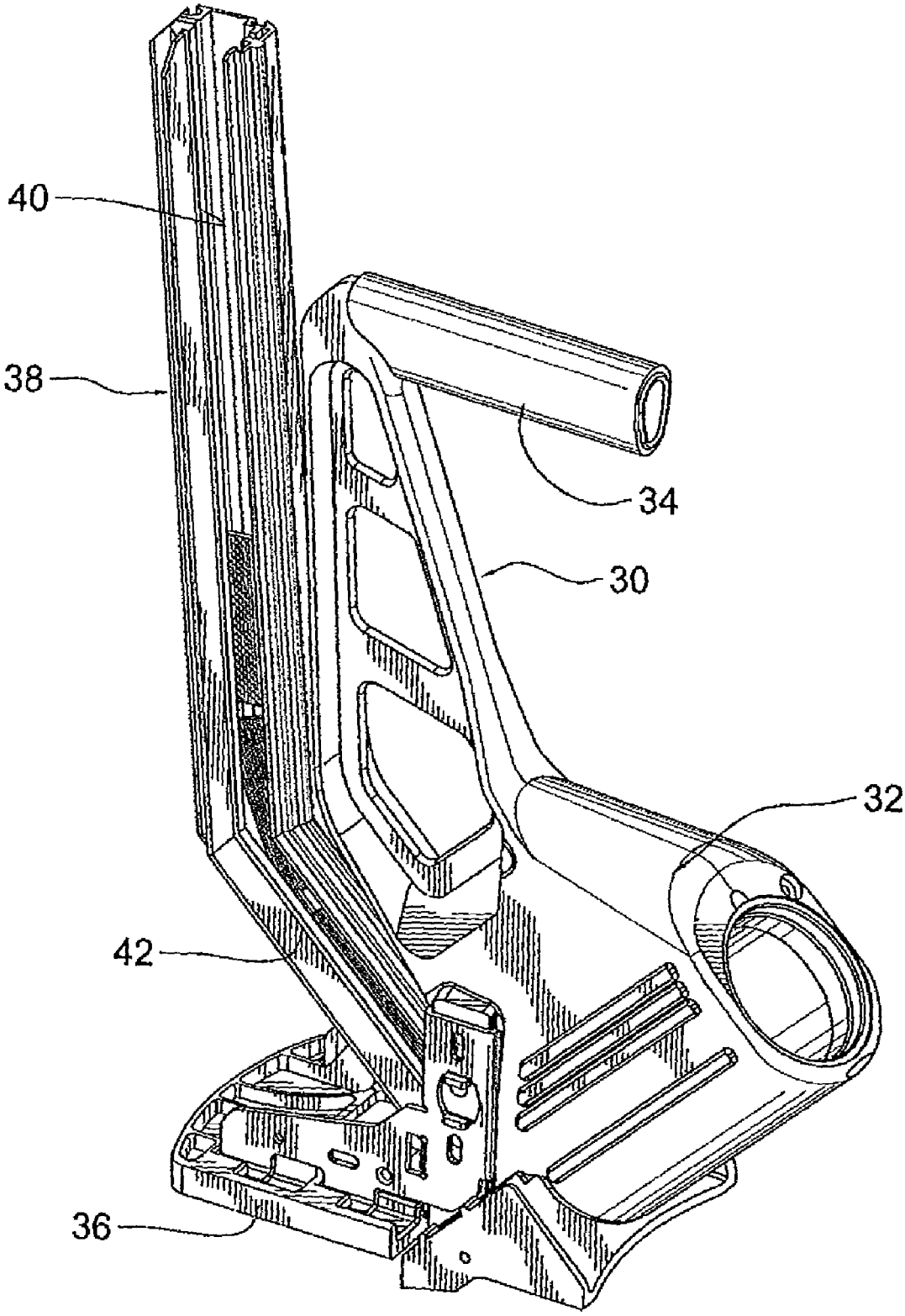
FIG. 4 is a perspective view of a nailer being provided with a first embodiment of controlled action elbowed fastener feeder magazine assembly of the invention, for use with nails or cleats, the magazine outer end portion being upright in the operative condition of the nailer, as illustrated, and showing a nailer configuration where the feeder magazine can only be fed into the elongated outer magazine segment, the elbowed fastener feeder magazine being shown without the fastener pusher for clarity of the view of the strips of fasteners moving down thereinto.
Figure 5:
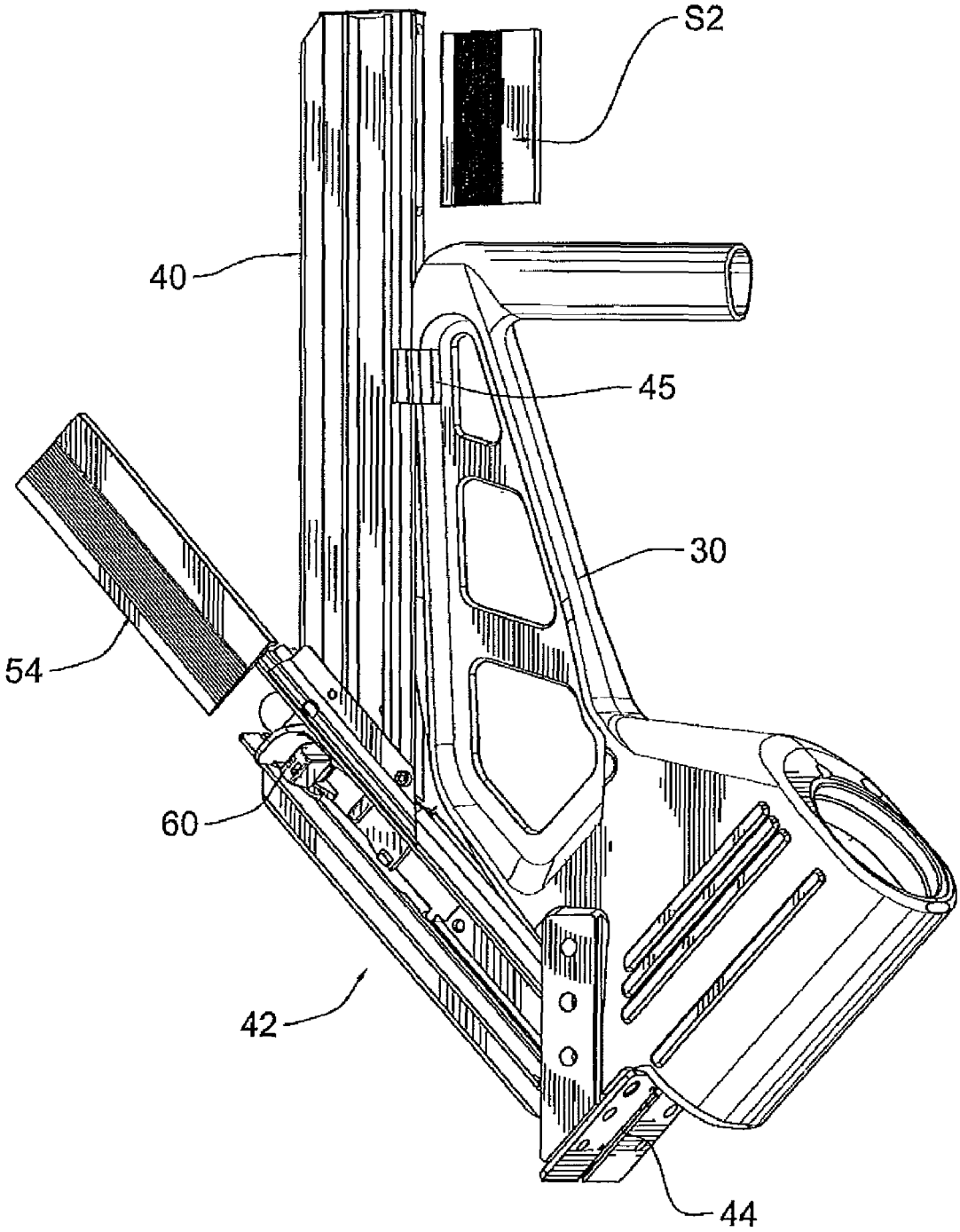
FIG. 5 is a view similar to that of the nailer of FIG. 4, but with the fastener strip removed, and showing a configuration where fasteners can be fed in two different ways: half fasteners strips (52) into both the elongated outer magazine segment and the inner magazine segment, or full fasteners strips (54) solely into the inner magazine segment.

The nailer 30 of FIGS. 4-5 includes a main frame 32, from which upwardly extends a top handle 34 and from winch forwardly extends a bottom shoe 36 therebeneath. An elbowed magazine assembly 38 is further provided, with an outward upper segment thereof 40 being substantially upright in nailer operative condition and generally parallel to the rear of the frame of horizontal handle 34 in nailer operative condition over horizontal flooring to be nailed, and with an inward lower segment thereof 42 being downwardly rearwardly inclined and fixed to the main frame 32 in register with a coextensive bottom fastener ejection channel 44. Shoe 36 is conventionally mounted onto brackets (not illustrated) also affixed to main frame 32.

By "elbowed" magazine assembly, we mean to say that there are at least two straight magazine segments operatively interconnected in fasteners slidethrough fashion in a non-coaxial fashion, for example in an angular (for example V-) shape, and also arcuately (for example C-) shape.

Preferably, as illustrated in FIGS. 4-5 of the drawings, elbowed magazine assembly 38 will abut against and closely follow the contour of adjacent main frame 32 immediately beneath handle 34.

Figure 7:
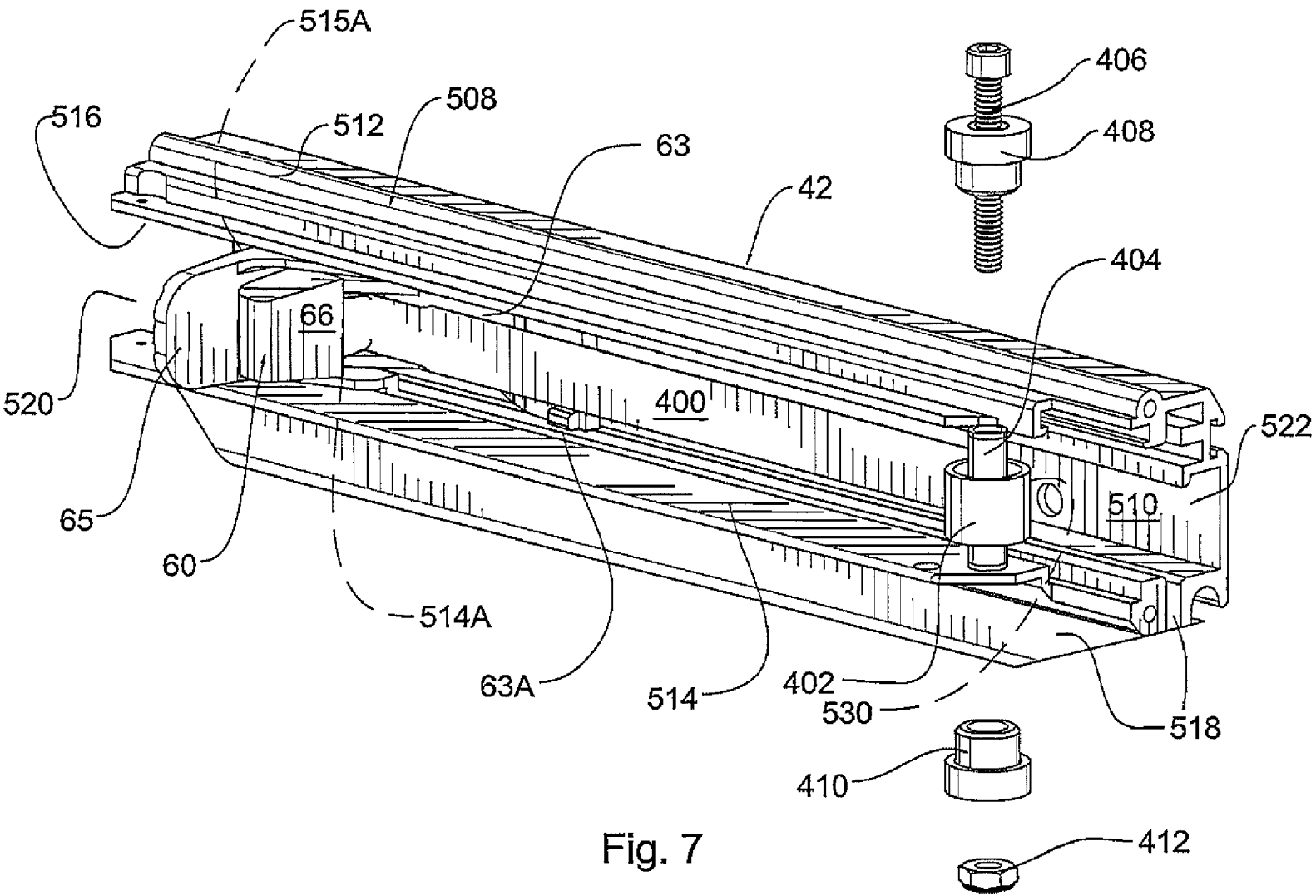
FIG. 7 is a partly exploded perspective view of the inner magazine segment of the fastener magazine assembly and associated fastener pusher means of FIG. 5, at an enlarged scale relative to that of FIG. 6.
Figure 7A:
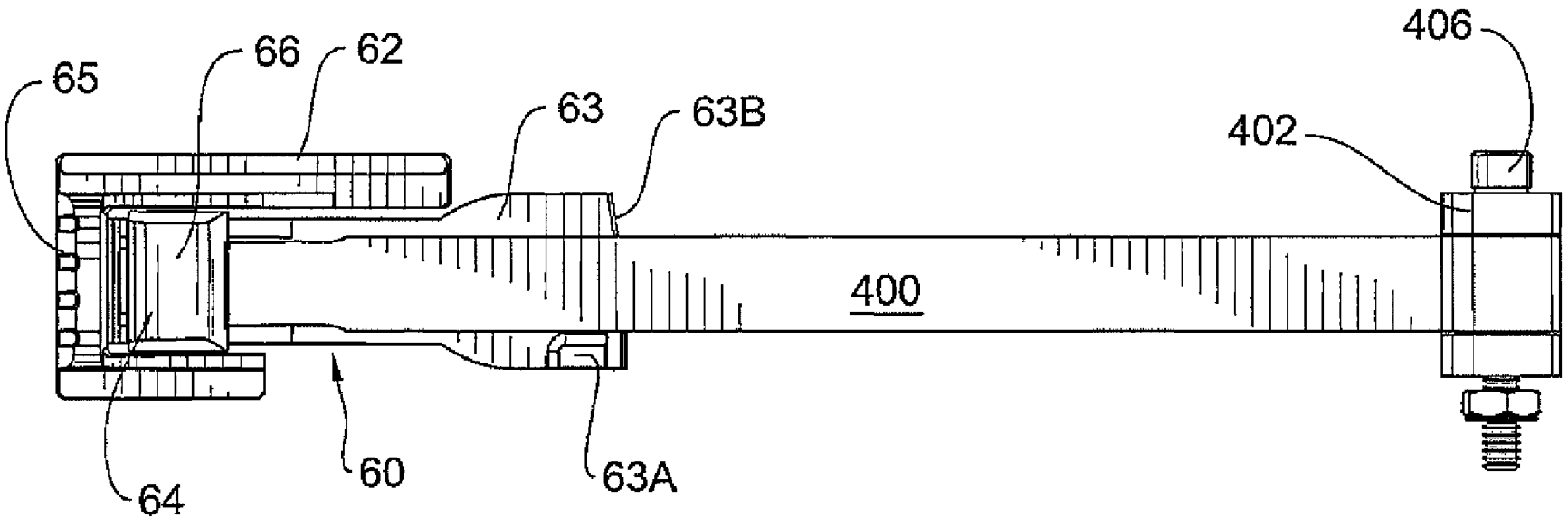
FIG. 7A is an enlarged top plan view of the fastener pusher means of FIG. 7, showing how the outer end portion of the elongated tensional linear blade is wound around its spool journalled into the magazine fastener discharge end portion.
Figure 7B:
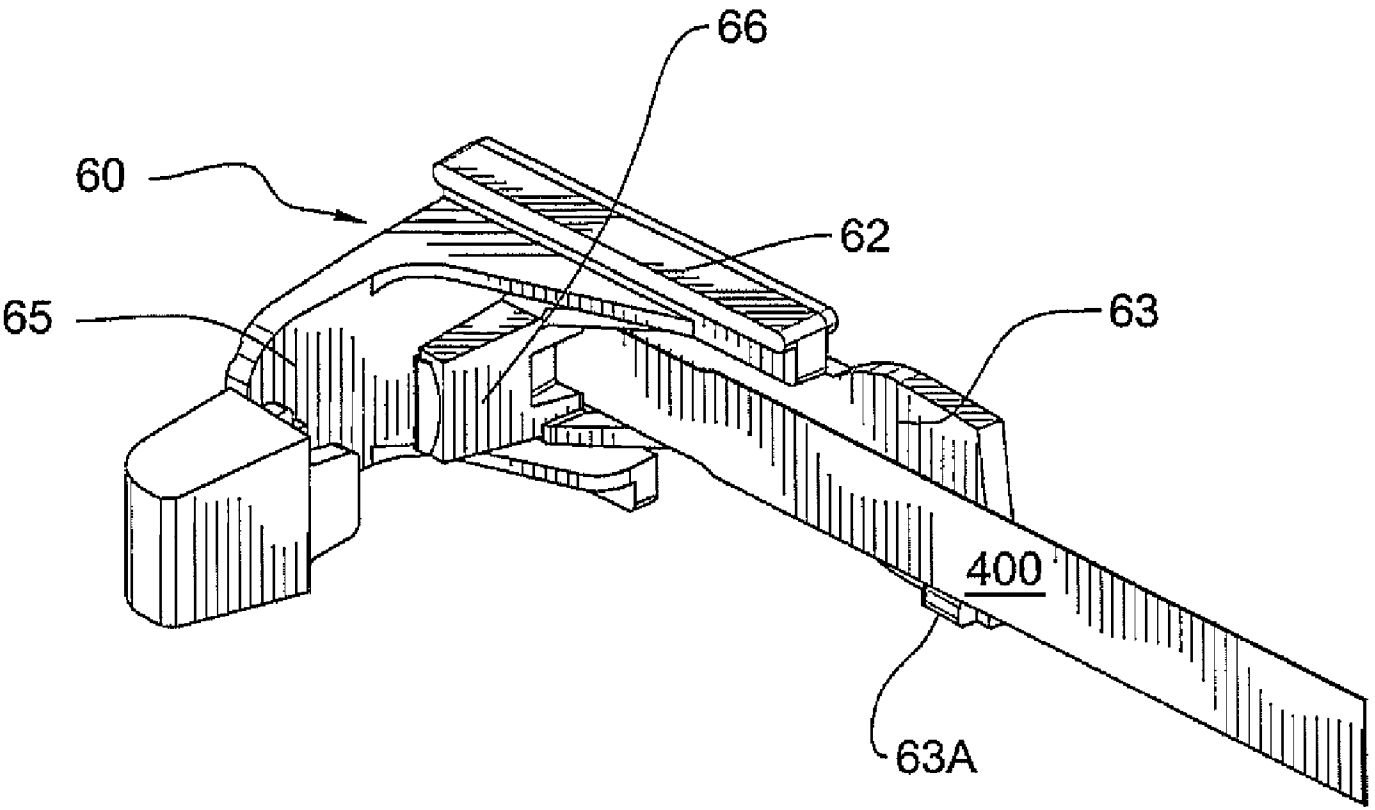
FIGS. 7B and 7D are enlarged perspective views of the left hand portion of FIG. 7A, showing how the elongated linear blade is anchored at its inner end to the pusher means main frame.

As shown in FIGS. 5 and 7, magazine segments 40, 42, of FIGS. 4-5, are preferably made from extruded aluminum. Each magazine segment 40, 42, forms an elongated generally cross-sectionally U-shape frame 508 for controlled action of feeder magazine 38, defining an elongated flooring 510, two opposite side walls 512, 514, transverse to flooring 510, and a lengthwise mouth 516 opposite flooring 510. An enlarged lengthwise channel 518 is formed spacedly proximate flooring 510 parallel thereto, for slidethrough passage of fastener strips 52, 54 through the inner hollow of magazine frame 508, from a fastener intake end portion 520 of outer magazine 40, to a fastener discharge end portion 522 of said magazine opposite fastener, intake end portion 520.

In inner magazine segment 42, a spring biased spool 402 is rotatably mounted by pivot mount 404 at fastener discharge end portion 522 to one or both of side walls 512, 514, spacedly proximate top mouth 516. A fastener pusher member 60 is connected to a spring-loaded coil or spool 402 by an elongated recoil tape or band 400, so that pusher member 60 is movable between a first limit position, spacedly proximate spool 402, at said fastener discharge outlet portion 522, to a second position (shown in FIG. 7) at said fastener intake end portion 520, against the spring pulling bias of spool extended recoil band 400. A lengthwise gap 530 is defined intermediate said fastener slide through channel 518 and said extended recoil band 400.

Figure 7C:
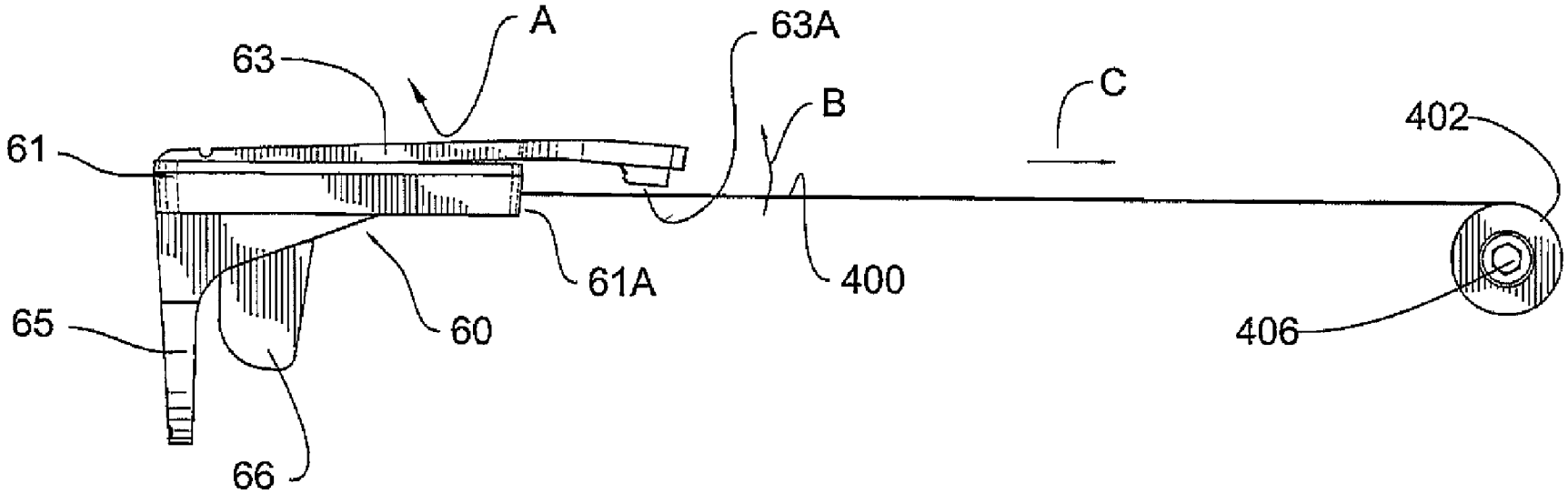
FIG. 7C is an inverted side elevational view of the fastener pusher means components of FIG. 7A, with the elongated tensional linear blade in edge view.
Figure 7D:
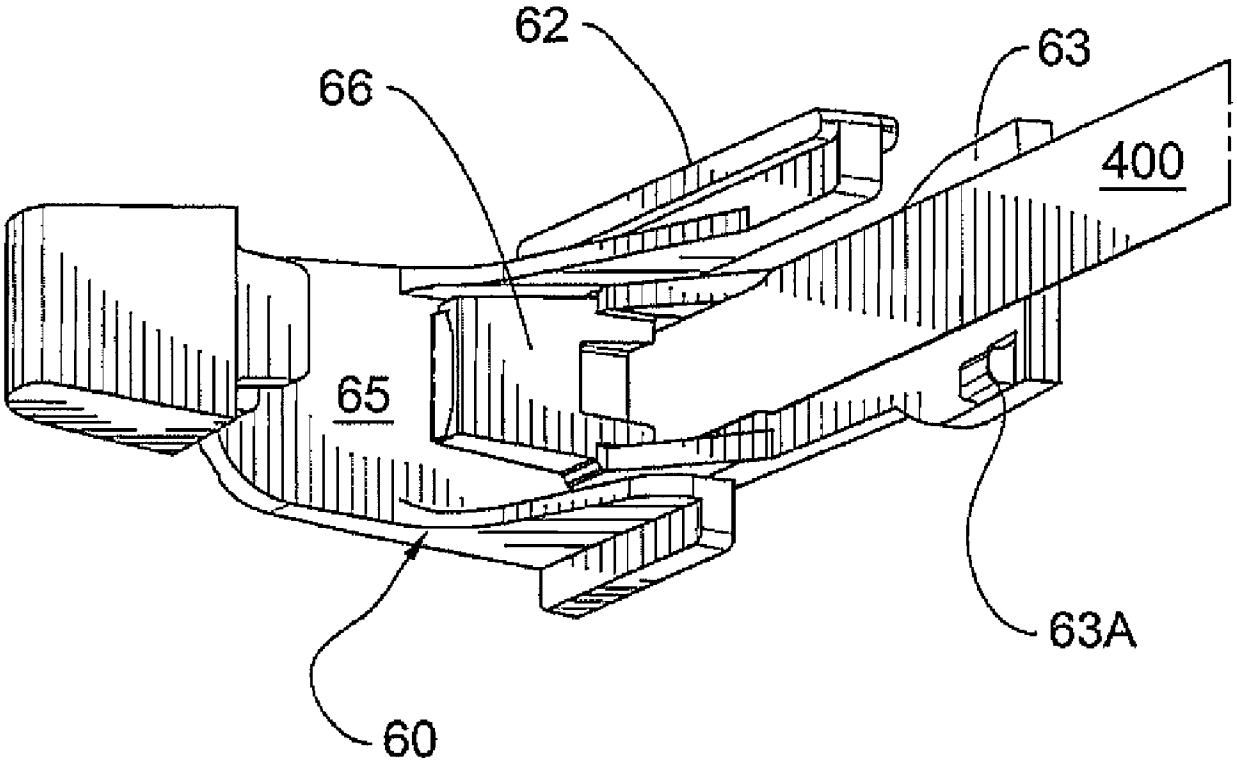
Figure 8:
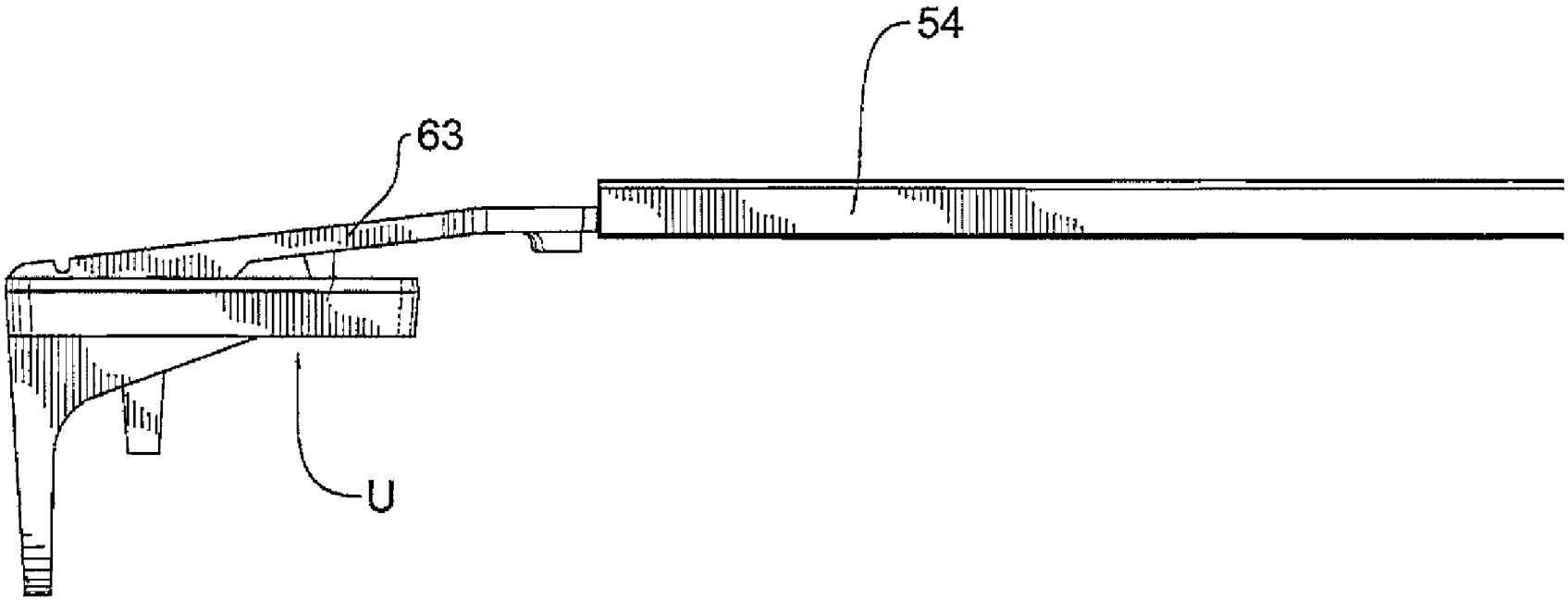
PRIOR ART Fig. 8
FIG. 8 is an edge view of a prior art fastener pusher means in operative condition against an associated strip of staples.
Figure 9:
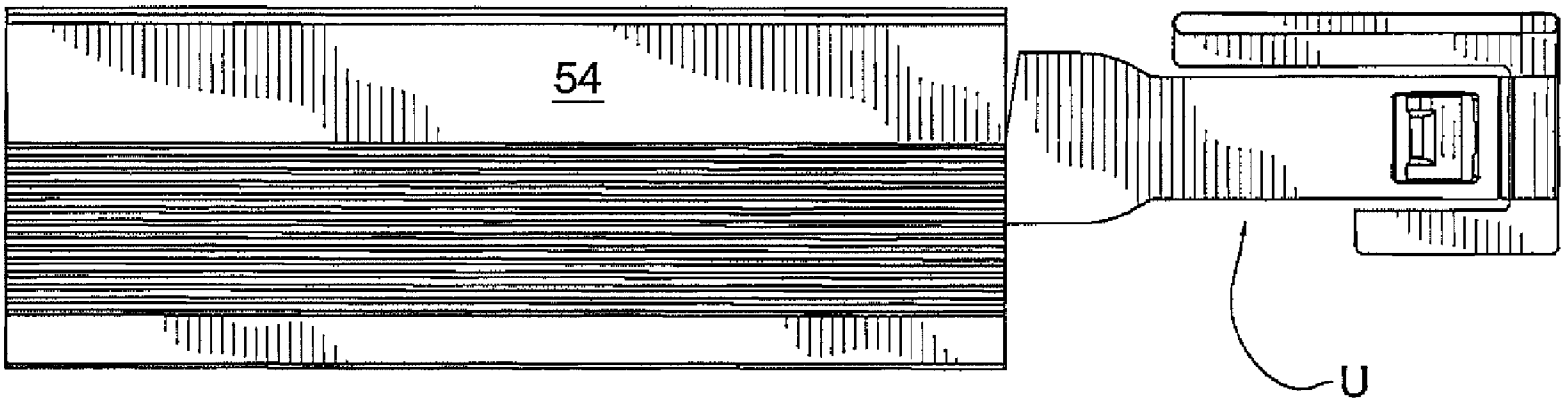
PRIOR ART Fig. 9
FIG. 9 is a bottom plan view of the prior art fastener pusher means and strip of staples of FIG. 8.
Figure 10:
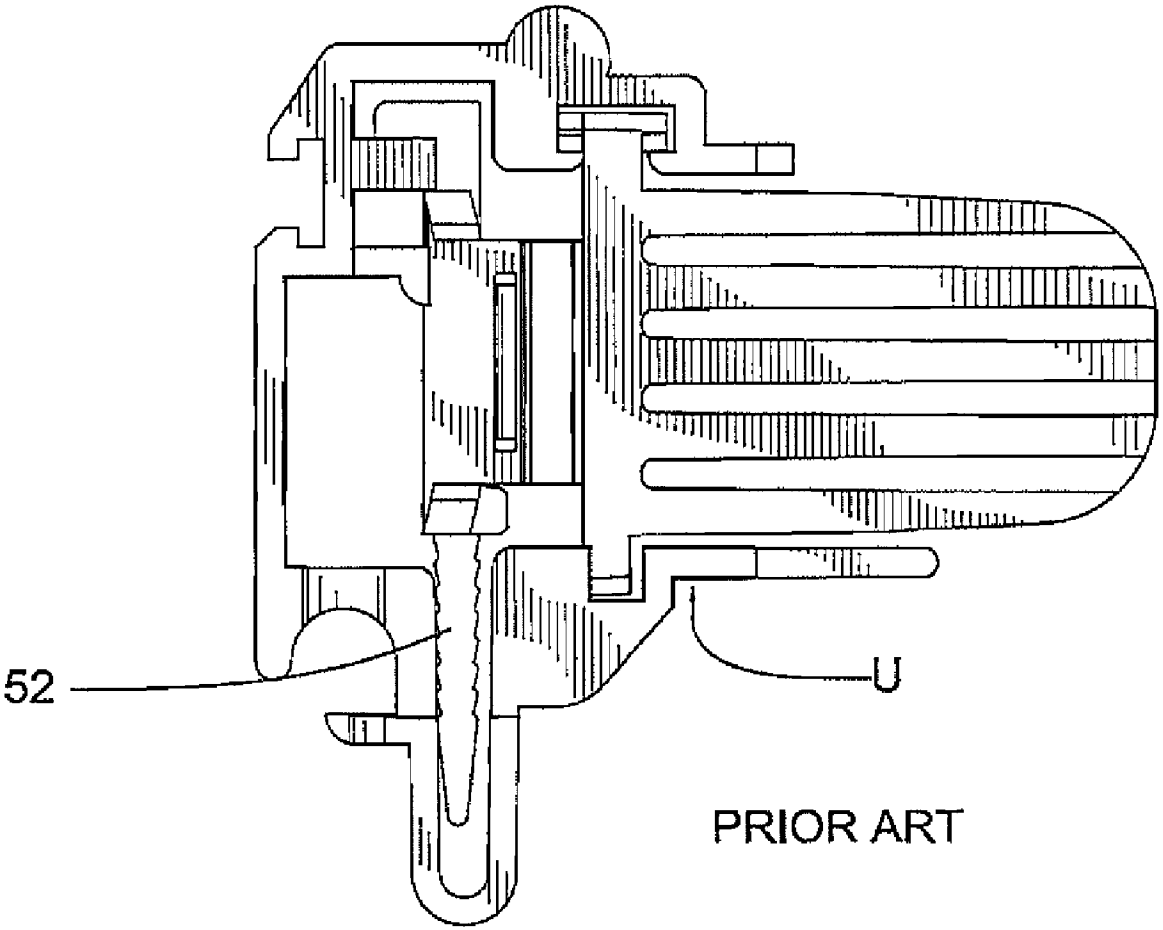
PRIOR ART Fig. 10
FIG. 10 is an end view of the prior art fastener pusher means from the left hand side of FIG. 8.

The fastener pusher member 60 in inner magazine segment 42 is thus continuously biased by a pulling force toward fastener discharge end portion 522 by linear blade 400 having one end portion wound around spool 402. Spool pivot mount 404 is pivotally secured in place on inner magazine segment 42 by a combination of bolt 406, swivel plugs 408 and 410, and nut 412. Pusher member 60 includes a resilient diverging pusher leg 63 (detailed later) having an outer end portion projecting into gap 530, so as to be able to register with and releasably abut against and to push any fasteners strip 52, 54, located in channel 518. The spring loaded linear blade 400 maintains leg 63 continuously abutted against fasteners 52, 54, in its extended condition (FIG. 8) under the winding pulling bias thereof about spool 402. In FIG. 7C, arrows A, B suggest the upward tilt motion capability of pusher leg 63, while arrow C suggests the pulling (winding) motion of linear blade 400 applied to pusher 60 responsively to the bias of spring loaded spool 402.

Figure 6:
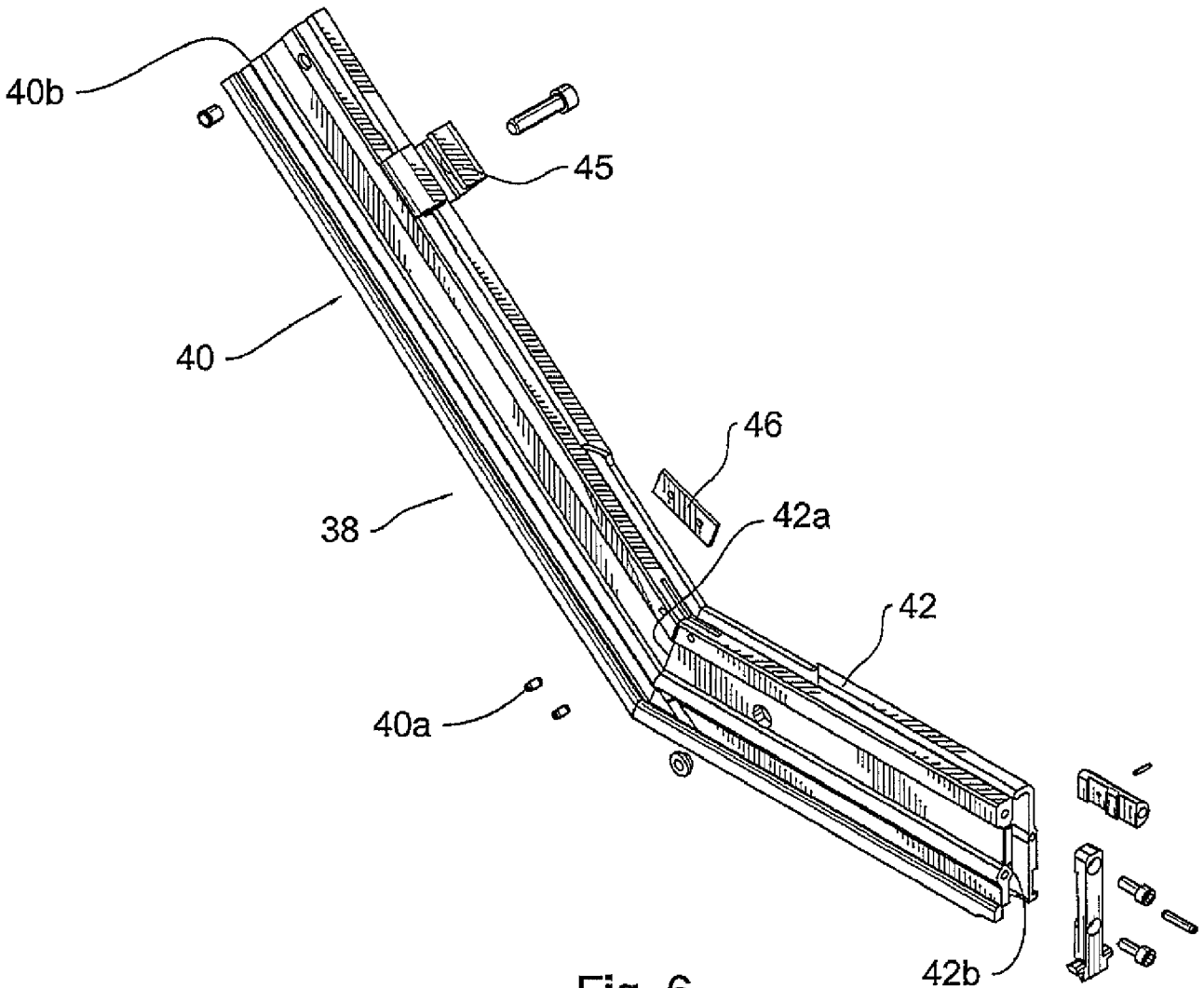
FIG. 6 is an exploded perspective view of an alternate embodiment of controlled action feeder magazine, for staples.

As illustrated in FIGS. 5-6, upper magazine segment 40 is preferably anchored to nailer main frame 32 adjacent handle 34 by an attachment bracket 45 (FIG. 6), to maintain substantially upright (vertical) orientation of magazine segment 40 in operative condition of nailer 30 (i.e. when nailer 30 stands upright on shoe 36 as shown in FIG. 4). FIG. 6 shows that the two magazine sections 40 and 42 are in fact two separate straight cross-sectionally V-shape frame members, with complementary bevelled edges 40*a*, 42*a*, that are releasably attached to each other in angularly coextensive fashion by connectors such as for example bracket 46 and bolts 50.

As shown in FIG. 7, the size and shape of cross-sectionally U-shape frames 508, are such that:

smaller number of fasteners in a fastener strip, for example a half fragment of fasteners strip of up to 50 or 60 fasteners strong fasteners strip 52 (e.g. broken down from a standard set of 100 to 120 fasteners strong fasteners strip 54) may be fed through fastener intake mouth 520 of upper magazine segment 40 brought to slide lengthwisely along this upper fastener slidethrough channel section 518 of magazine segment 40, then engage the elbowed section 40*a*, 42*a*, of the magazine, leave the first channel 518 and engage the second channel 518 of inner magazine segment 42, down to the fastener ejection outlet 522 of inner magazine segment 42; the shape and size of channels 518, 518, are such as to accommodate the angular shift from non-coaxial frames 40, 42, at their bevelled edge transition 40*a*, 42*a*, wherein free passage of the shorter fastener strips 52 (exclusively of the longer fastener strips 54) is enabled.

alternately, as shown in FIG. 5, larger number of fasteners in a fasteners strip, i.e. for example a standard set of 100 to 120 fasteners strong fastener strip 54, could be fed directly to inner magazine frame 42 through an intermediate channel mouth corresponding to the top bevelled edges 42*a*, thus avoiding altogether the engagement by the fasteners into top channel 40*b* of upper magazine segment 40; which would then require that connector elements 46, 50, interconnecting magazine sections 40 and 42 be previously released since only inner magazine segment 42 would remain.

Of course, gravity feeding the long fastener strip 54 solely through inner magazine segment 42 does not provide the advantage of exploiting the full capability of the pair of non-coaxially mounted coextensive U-frames 40, 42, but it can be done if required. The optimal way of doing things would be to feed multiple shorter length fasteners strips 52 of less than approximately 50 to 60 fasteners each, through the top mouth 40*b*, as this would provide maximum autonomy of the nailer tool 30 before recharges of fastener strips.

Figure 18:
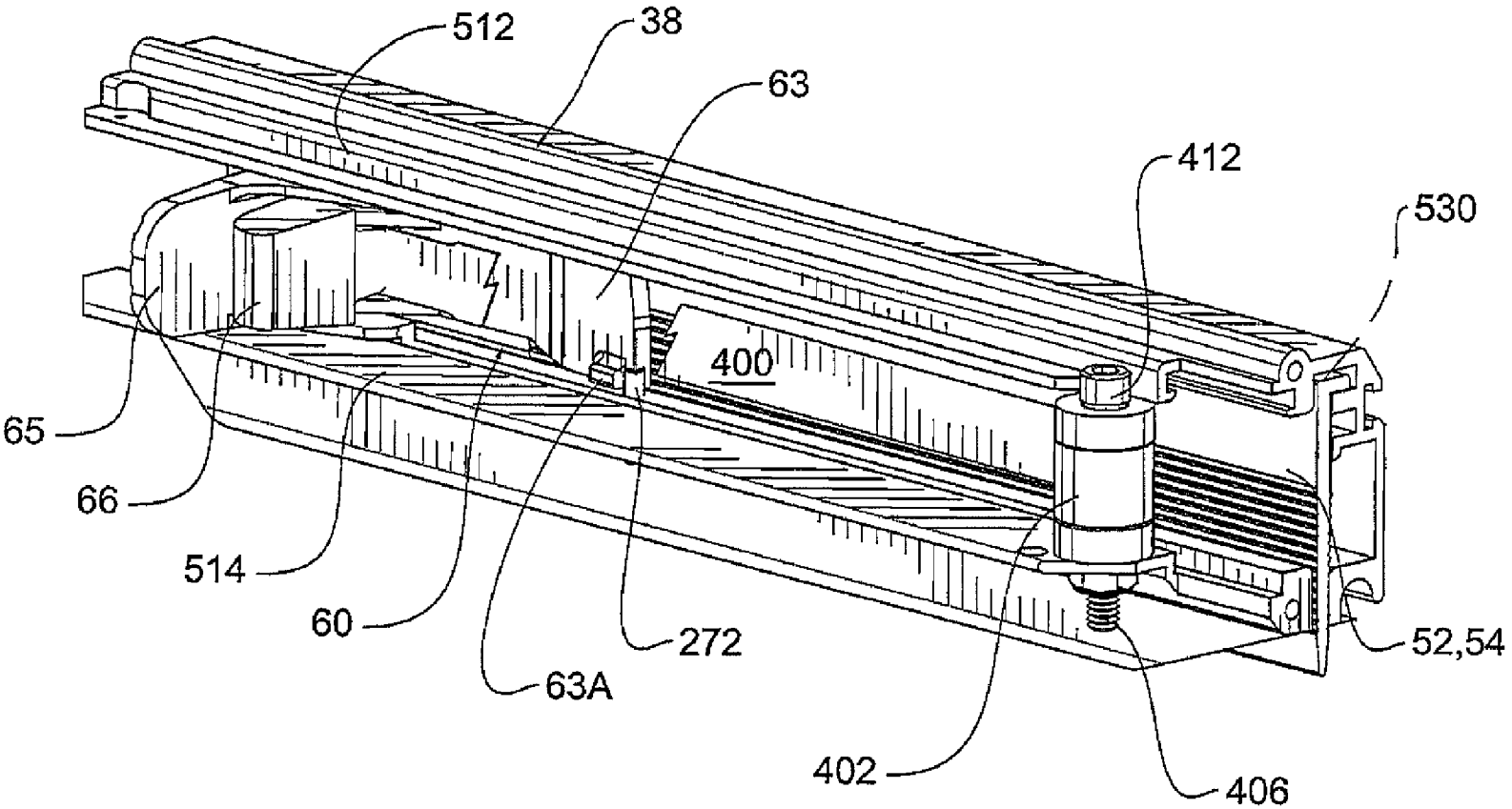
FIGS. 18 and 18A are perspective views of the fastener pusher and associated magazine and releasable pusher retention device according to a second configuration of said preferred pusher, the magazine frame being removed in FIG. 18A.
Figure 18A:
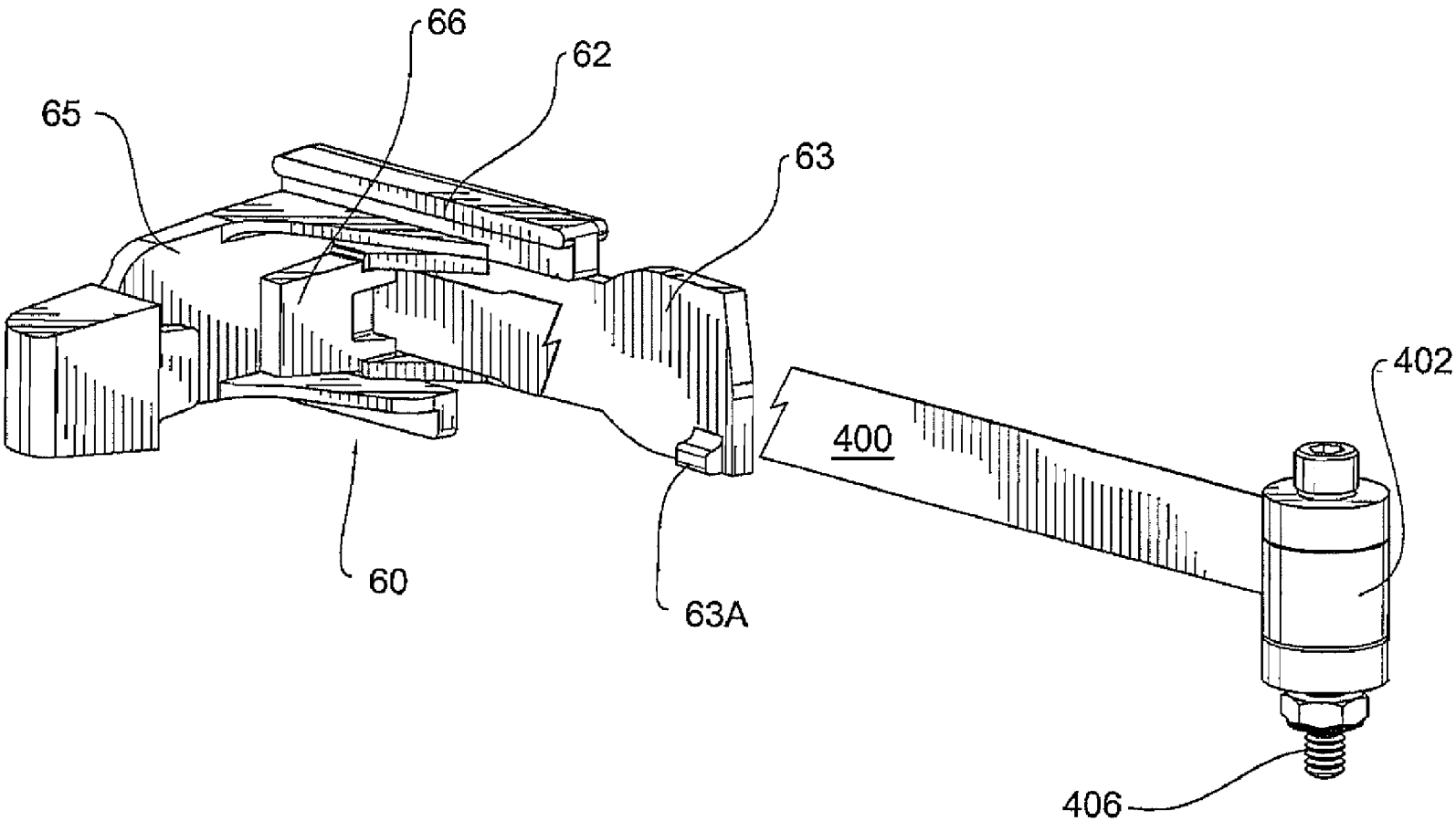
Figure 25:
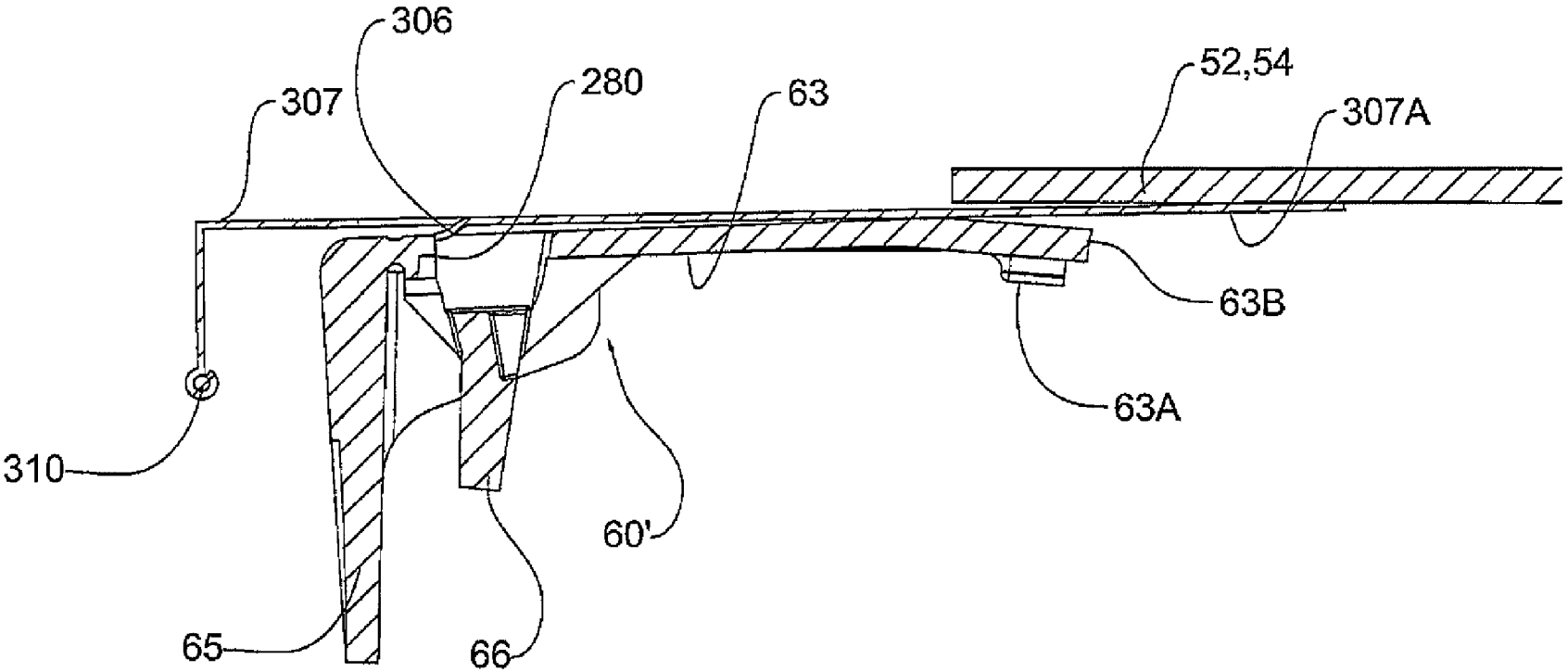
FIG. 25 is a view similar to that of FIG. 11, but in cross-section and showing a fastener strip and a third configuration of fastener pusher and releasable pusher retention device for controlled action feeder magazine according to the most preferred embodiment of the invention, the pusher retention device shown in its pusher retention device operative state.
Figure 25A:
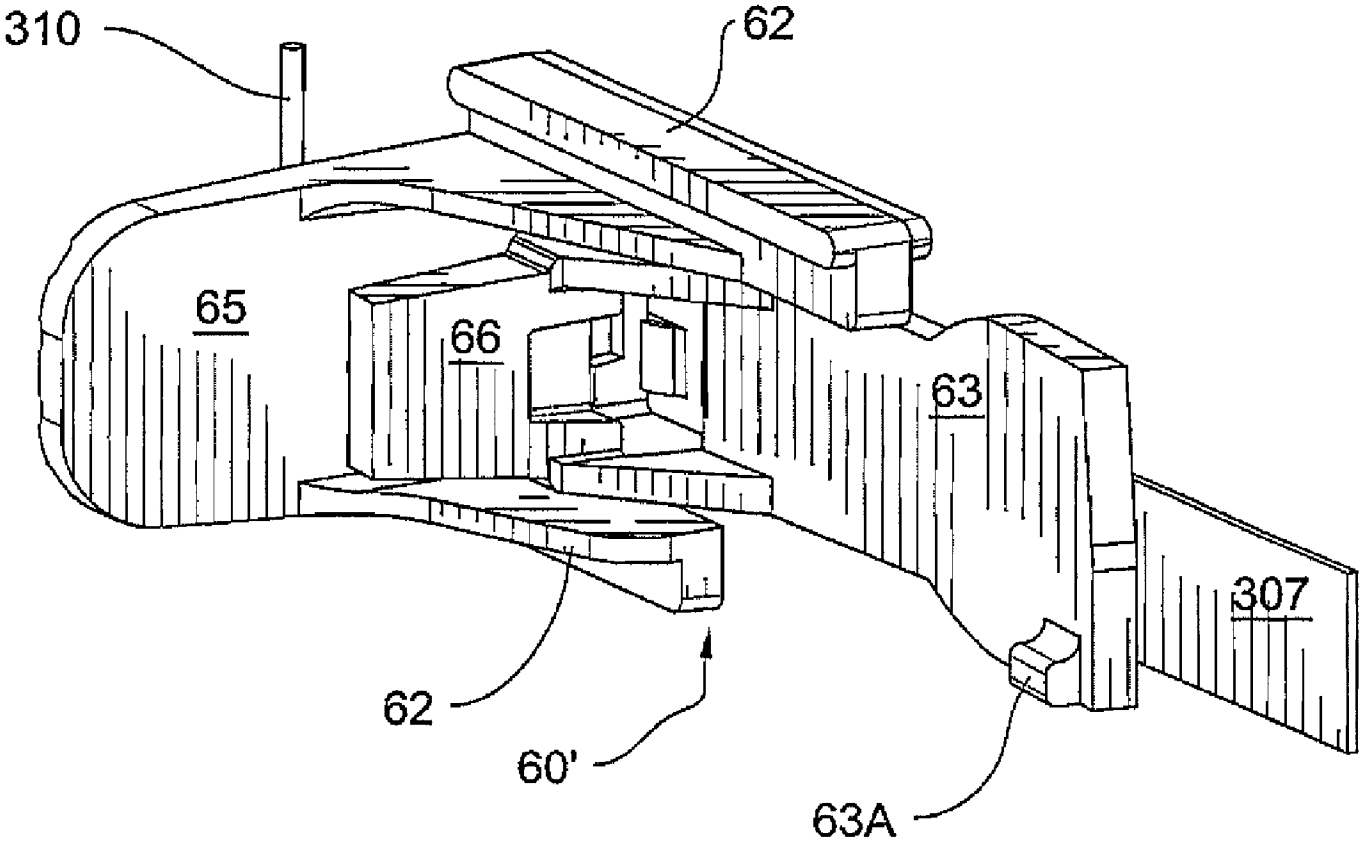
FIG. 25A is an enlarged perspective view of the components of FIG. 25, but without the fastener strip.
Figure 26:
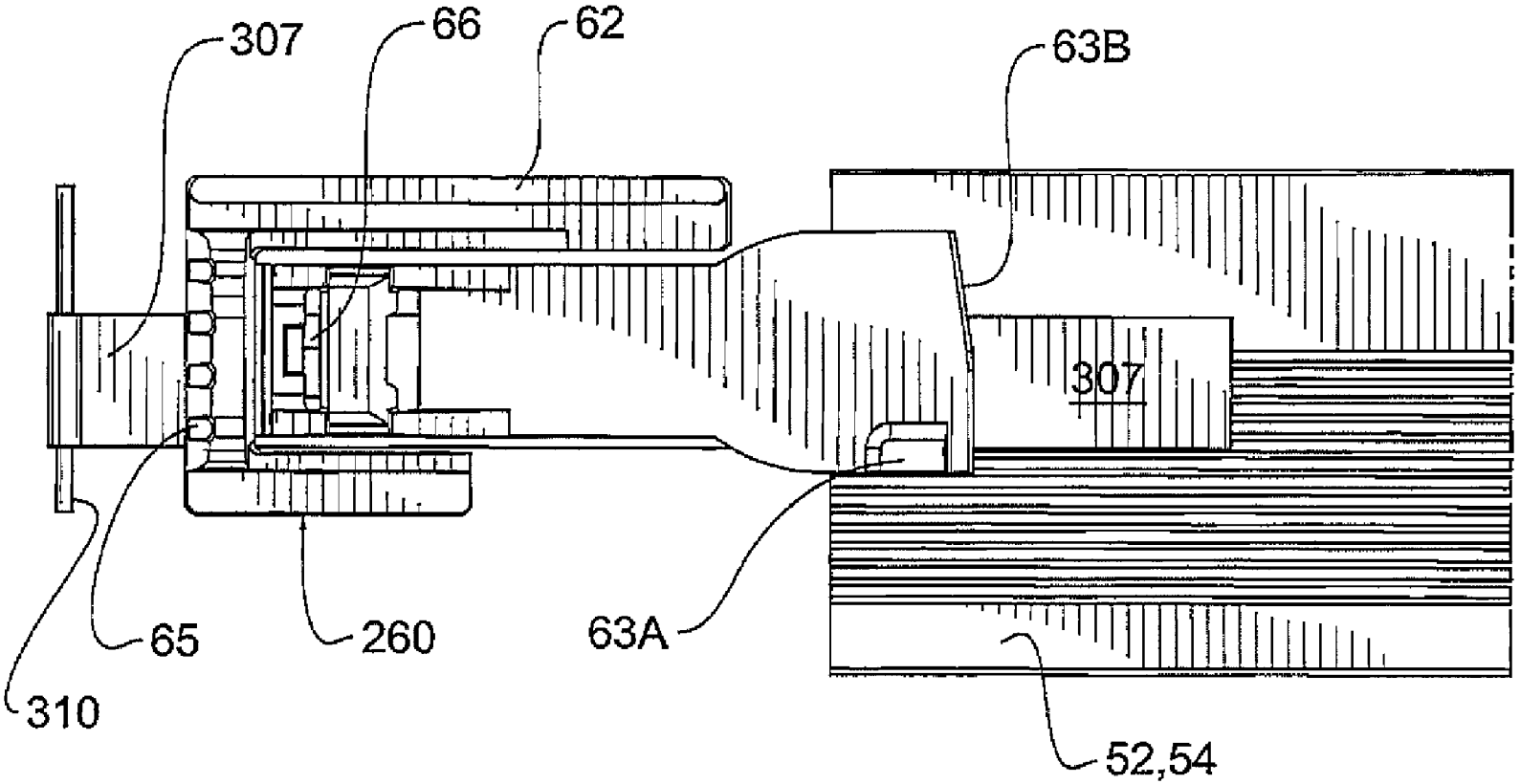
FIG. 26 is a top plan view of the components of FIG. 25.

The present elbowed magazine 38 should work fine simply in a gravity fed fashion for the fastener strips 52 or 54 sliding along angularly offset coextensive U-channels 518, 518. However, as illustrated in FIGS. 11, 18 and 25, it is possible to enhance performance of the nailer 30 by adding an assembly of fastener pusher 60 and pusher retention device (162, 63A-272, and 307-310, see hereinbelow) to the inner magazine segment 42.

A first embodiment of pusher member and of pusher retention device assembly for controlled action of lower magazine 42 is shown in FIGS. 11-17. In such an arrangement, the fasteners 52 or 54 inside upper upright magazine segment 40 are fed downwardly only by gravity forces, while as for the fasteners 52 or 54 inside the lower magazine segment 42, fastener pusher 60 becomes automatically engaged behind the last fastener thereof, once the fastener strip 52 or 54, becomes sufficiently partially depleted in fasteners.

Figure 11:
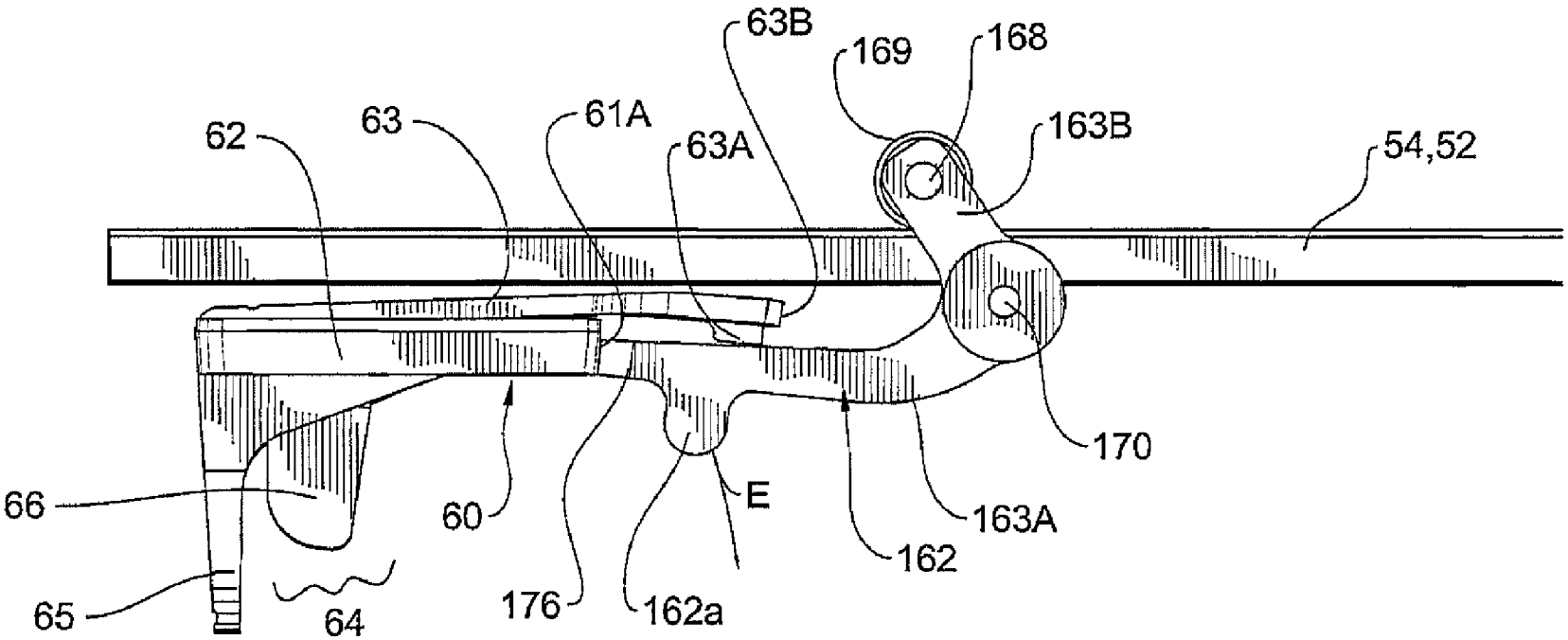
FIG. 11 is a view similar to that of FIG. 8, but showing a first embodiment of releasable pusher retention device for controlled action feeder magazine shown in its pusher retention state.
Figure 12:
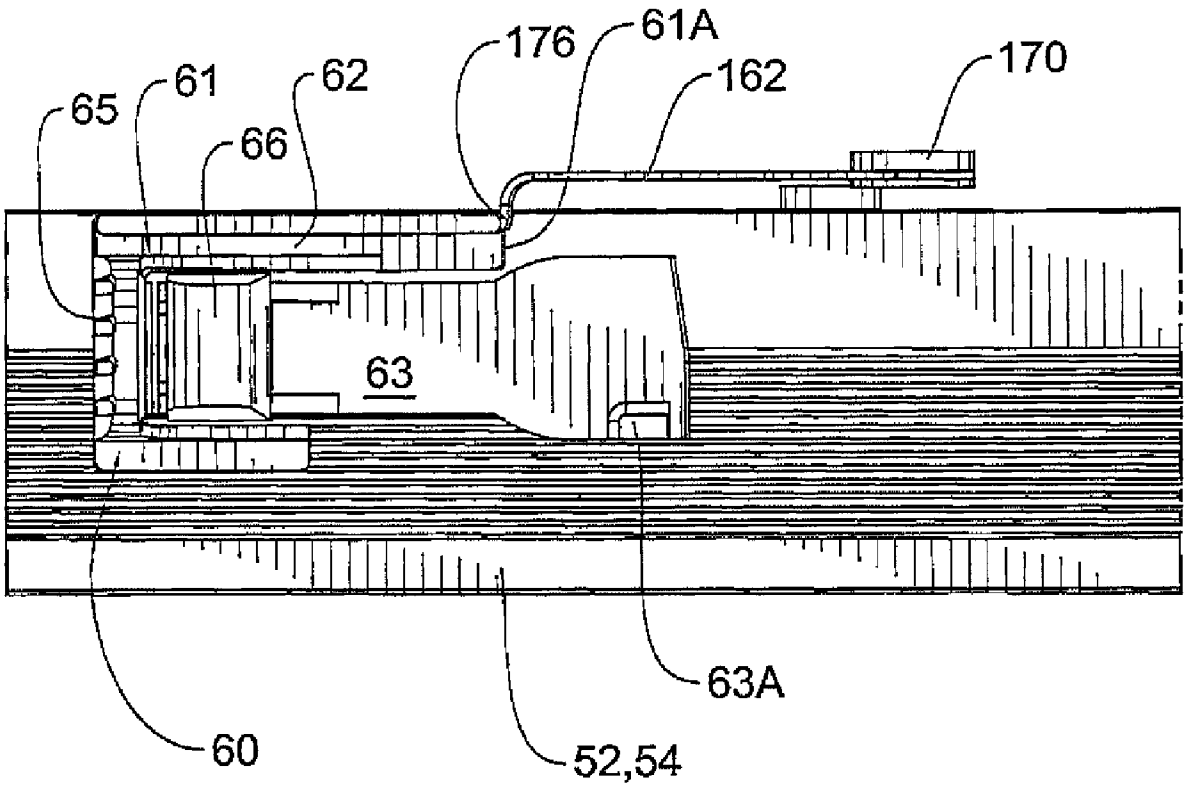
FIG. 12 is a top plan view of the pusher means, pusher retention device and strip of staples of FIG. 11.
Figure 13:
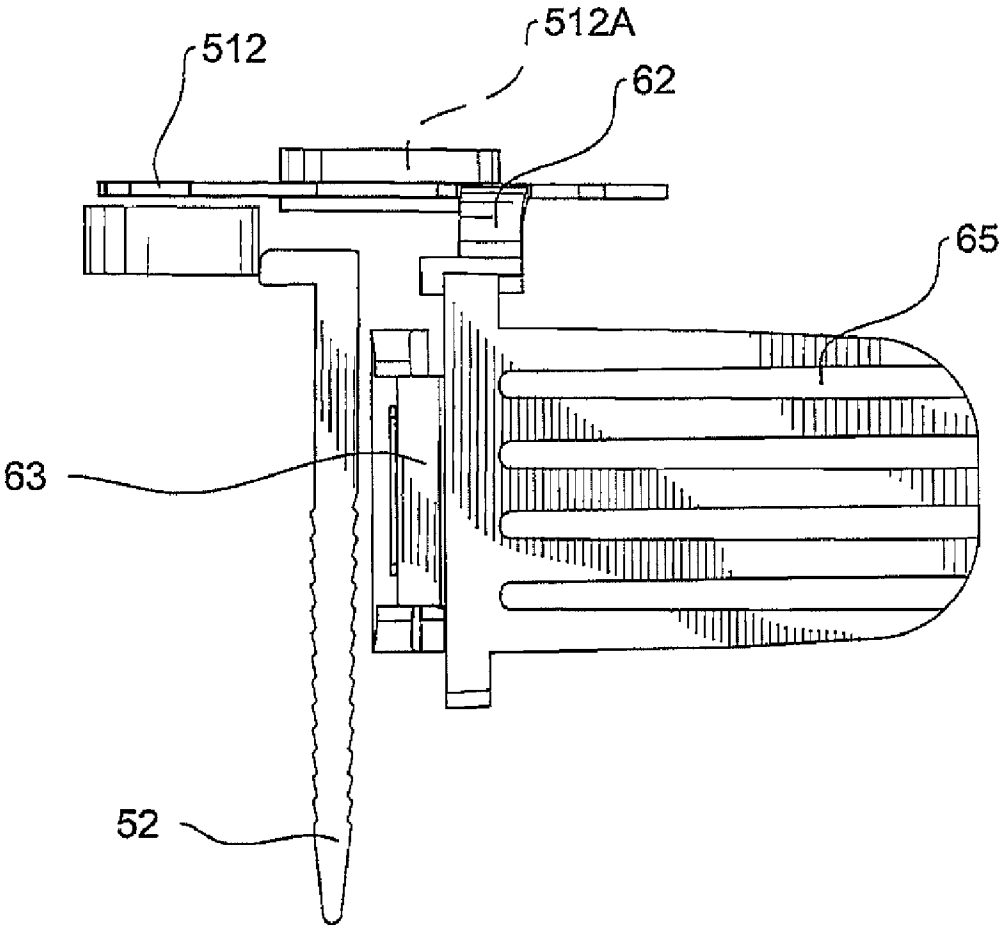
FIG. 13 is an end view similar to FIG. 10, but for the embodiment of FIG. 11.
Figure 14:
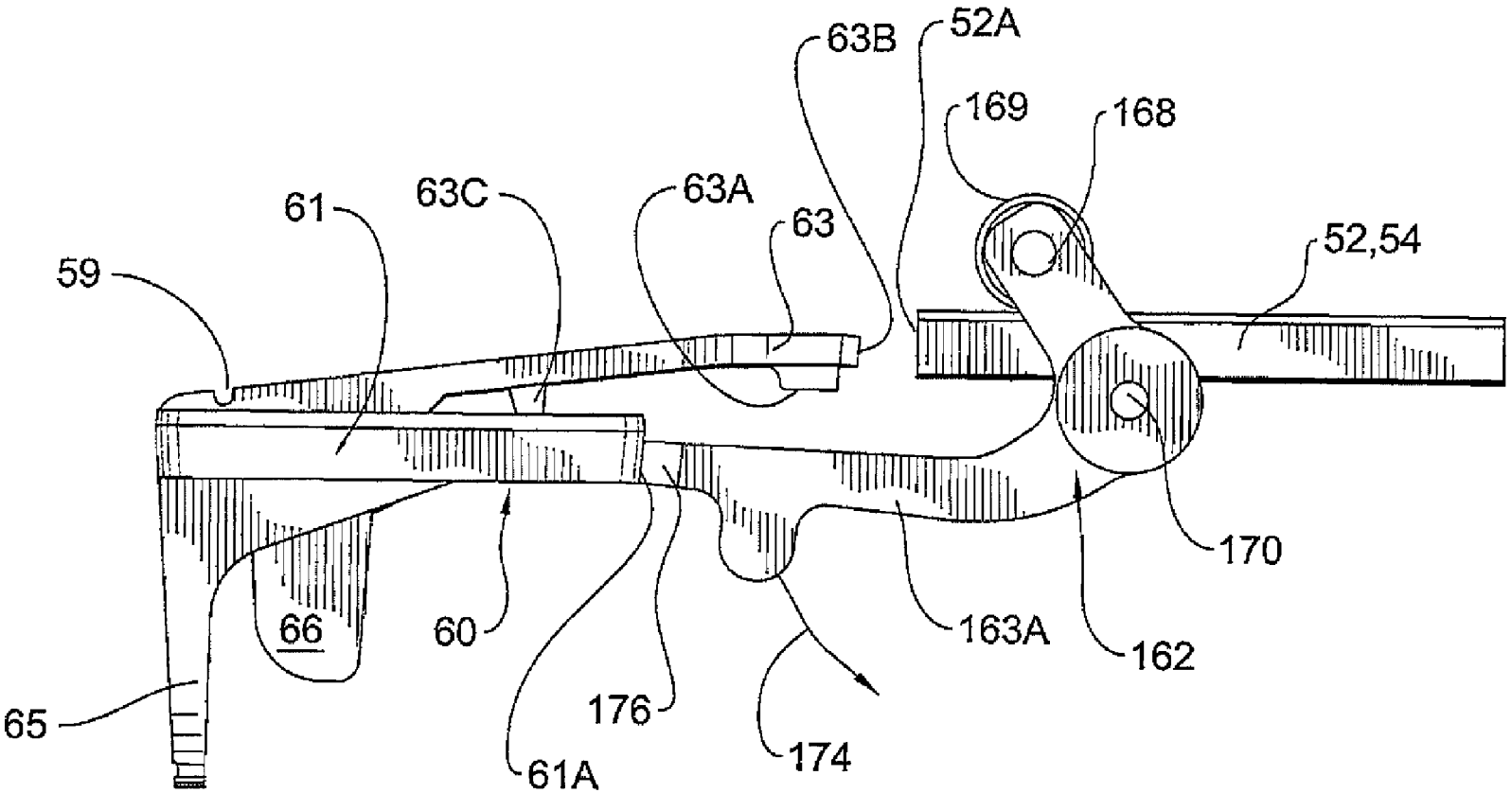
FIG. 14 is a side elevational view similar to FIG. 11, but with the strip of fasteners being partly depleted so that the pusher head tilts to its registering position coplanar with the fasteners strip.
Figure 15:
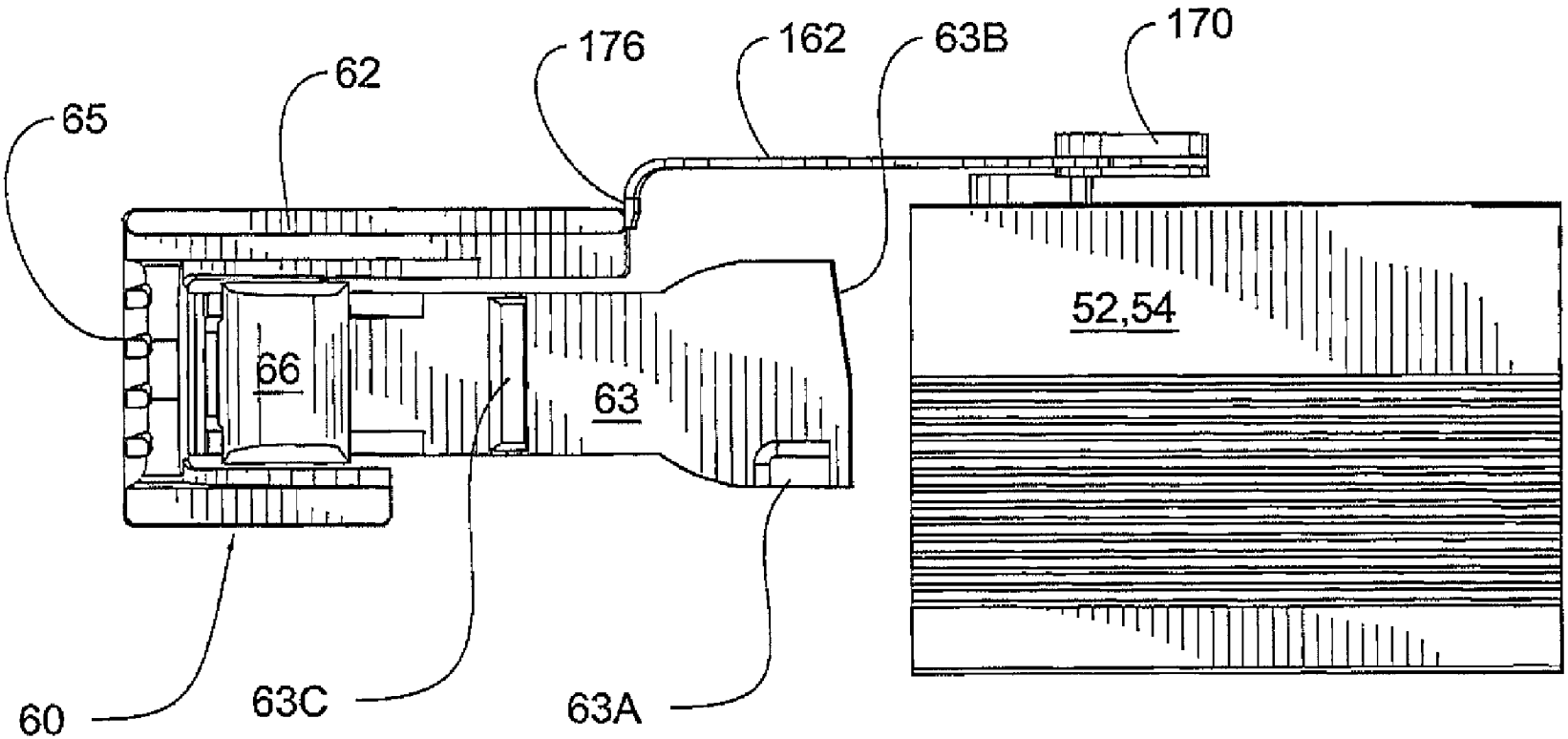
FIG. 15 is a top plan view of the pusher and strip of fasteners of FIG. 14.
Figure 16:
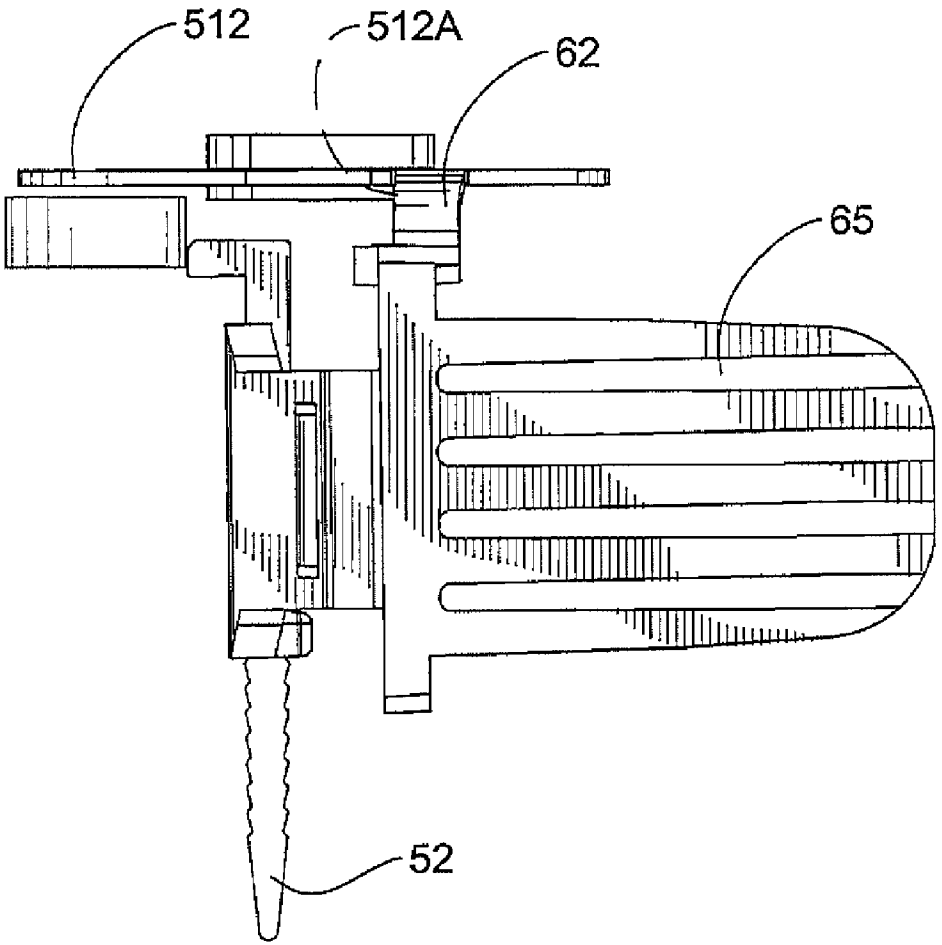
FIG. 16 is an end view similar to FIG. 13, but corresponding to the fastener depletion state of FIG. 14.

More particularly, FIGS. 11-13 show when the magazine 38 is fully loaded with a strip of fasteners 52, 54, or alternately when the load is only a fraction of the total capability but still exceeding a minimum threshold number of fasteners. The fastener pusher member 60 includes a main slider frame 61, having a slide base 62, a resilient pusher leg 63, and a pull tab assembly 64. Pull tab assembly 64 includes a larger outer pull tab 65, for manual engagement of the pusher member 60, and a smaller inner pull tab 66. The outer free end portion of pusher leg 63 includes a transverse stopper 63A. Slide base 62 slidingly engages complementary size channels 512A, 514A, (FIG. 7) in magazine side walls 512, 514, and is continuously retained therein. A flat seat 61A is formed ahead of slide base 62 intermediate tab 65 and stopper 63A, said flat seat 61A being generally parallel to tab 65. A shoulder member 63C (FIG. 15 or 17) transversely projects from pusher leg 63 intermediate tab 65 and outer leading edge 63B of leg 63, on the same side as stopper 63A; shoulder 63C is provided for sliding transverse engagement against recoil band 400 (FIG. 19) and to provide transverse spacing between diverging resilient leg 63 and band 400.

Shoulder member 63C thus provides enhanced outward tilt bias of the outer leading edge portion 63B of pusher leg 63, relative to band 400.

According to the invention, there is added arcuate pusher retention lever 162 having two opposite legs 163A, 163B. Leg 163A is adapted to come to releasably abut at its transverse free end portion 176 against the fastener pusher main frame seat 61A, thus preventing pusher 60 from moving toward the fastener discharge end portion 522 under pulling bias from recoil band 400. At this stage (FIG. 11), there is no biasing action from the fastener pusher 60 onto the fastener strips 52 or 54, since pusher leg 63 clears fasteners 52, 54, and thus the sliding motion of the latter is strictly gravity fed.

Figure 11A:
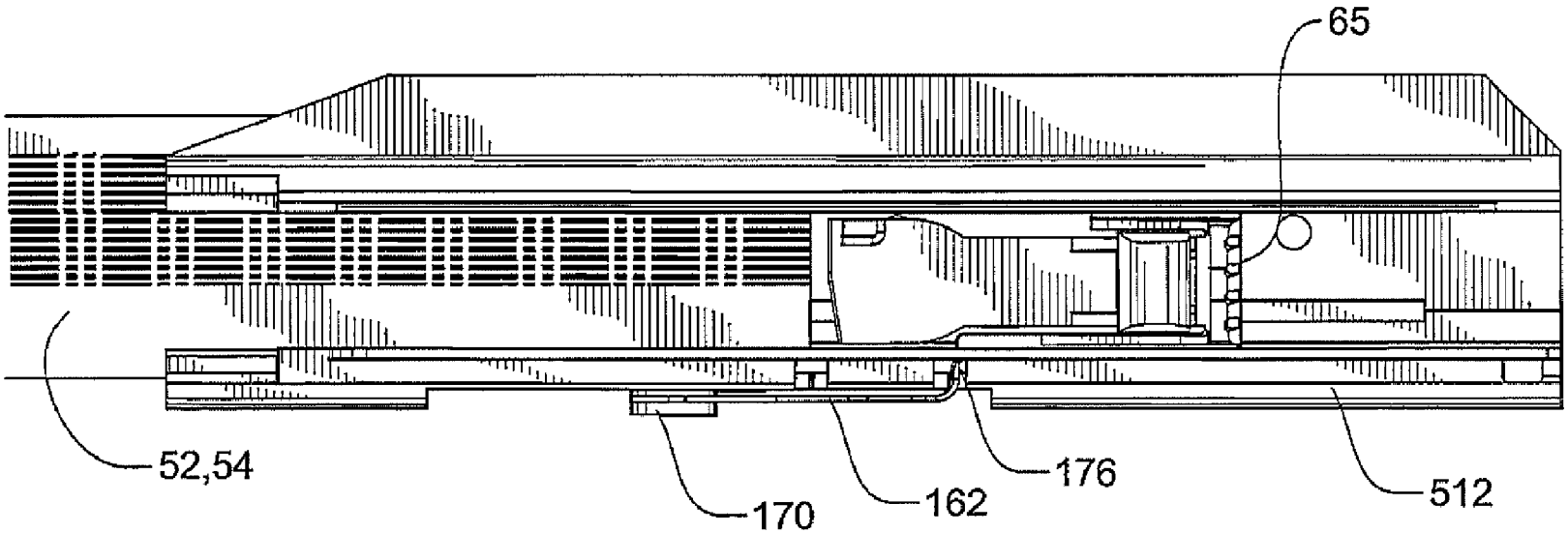
FIGS. 11A and 11B are a side view and a top plan view respectively of a fastener magazine fitted with the first embodiment of pusher device of FIG. 11, FIG. 11B being at an enlarged scale.
Figure 11B:
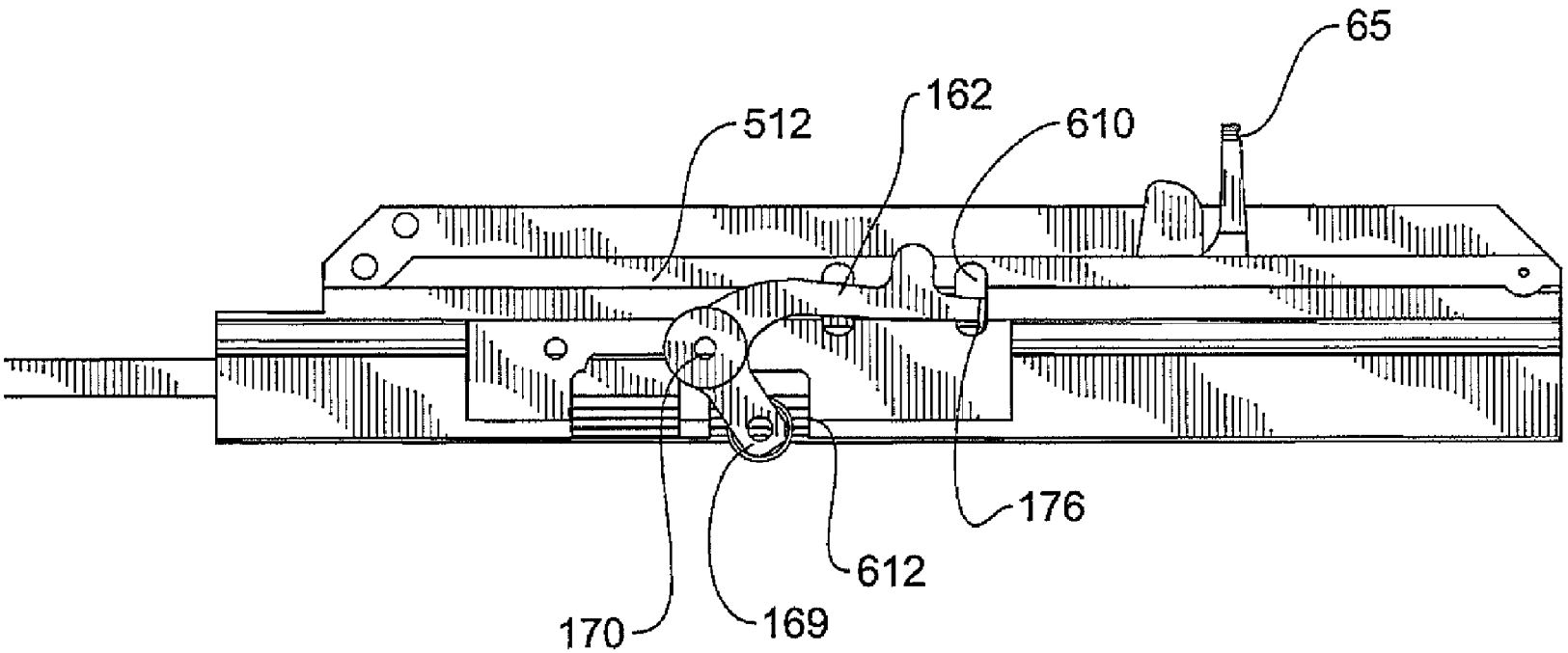

As best illustrated in FIGS. 11A, 11B and 12, pusher retention lever 162 extends on the exterior side of magazine side wall 512, except for transversely extending free end portion thereof 176 which extends through a bore 610 made through an intermediate section of side wall 512. A pivotal axle 170, also mounted exteriorly of magazine side wall 512 and rotatably journaled thereto, pivotally mounts the intermediate elbow apex of elbowed lever 162 to side wall 512. Leg 163B further carries at its outer free end a roller 169, pivotally mounted thereto at 168. Roller 169 is adapted to rollingly engage over the top edge side of underlying fastener strip 52, 54. Accordingly, roller 169 and corresponding pivot axle 168 also project from the exterior of magazine side wall 512, through a suitably sized aperture 612 in wall 512. In operation:

A. as shown in FIG. 11, when a full load of fasteners 52, 54, is present in the inner magazine 42, roller 169 at the end of leg 163B rolls over the side edge surface of the fastener strip 52, 54, while head 176 of lever leg 163A abuts against seat 61A of pusher member 60. Pusher retention lever 162 cannot rotate about its pivotal axle 170, since roller 169 rollingly abuts against the fastener strip 52, 54.

B. As shown in the intermediate step of FIG. 14, when the load of fasteners has been sufficiently depleted to clear the pusher head 63B while the roller 169 still remains in rolling contact with the fastener strip 52, 54, the pusher head 63B is automatically biased outwardly to bring its leading edge 63 B in (still spaced) coplanar register with the trailing edge 52A of the corresponding fasteners strip 52, 54. Such an outward biasing action onto resilient pusher leg 63 is brought about by release of compressive action of pusher shoulder 63C against the spring biased recoil band 400, onto which it lays, and also by some spring back memory recoil from a "hinge" formed by a notch 59 made onto the inner end portion of leg 63 opposite its leading edge 63 B and at the junction with tab 65. However, at this stage, the outer free end portion 176 of lever leg 163A remains firmly abutted against the front seat 61A of pusher member 60 coplanar therewith, since the pusher retention lever 162 still cannot rotate about pivot axle 170 because of the continuing cantilever action of pivot axles 168, 170 and associated roller 169 against the fastener strip 52, 54, therebetween.

Figure 17:
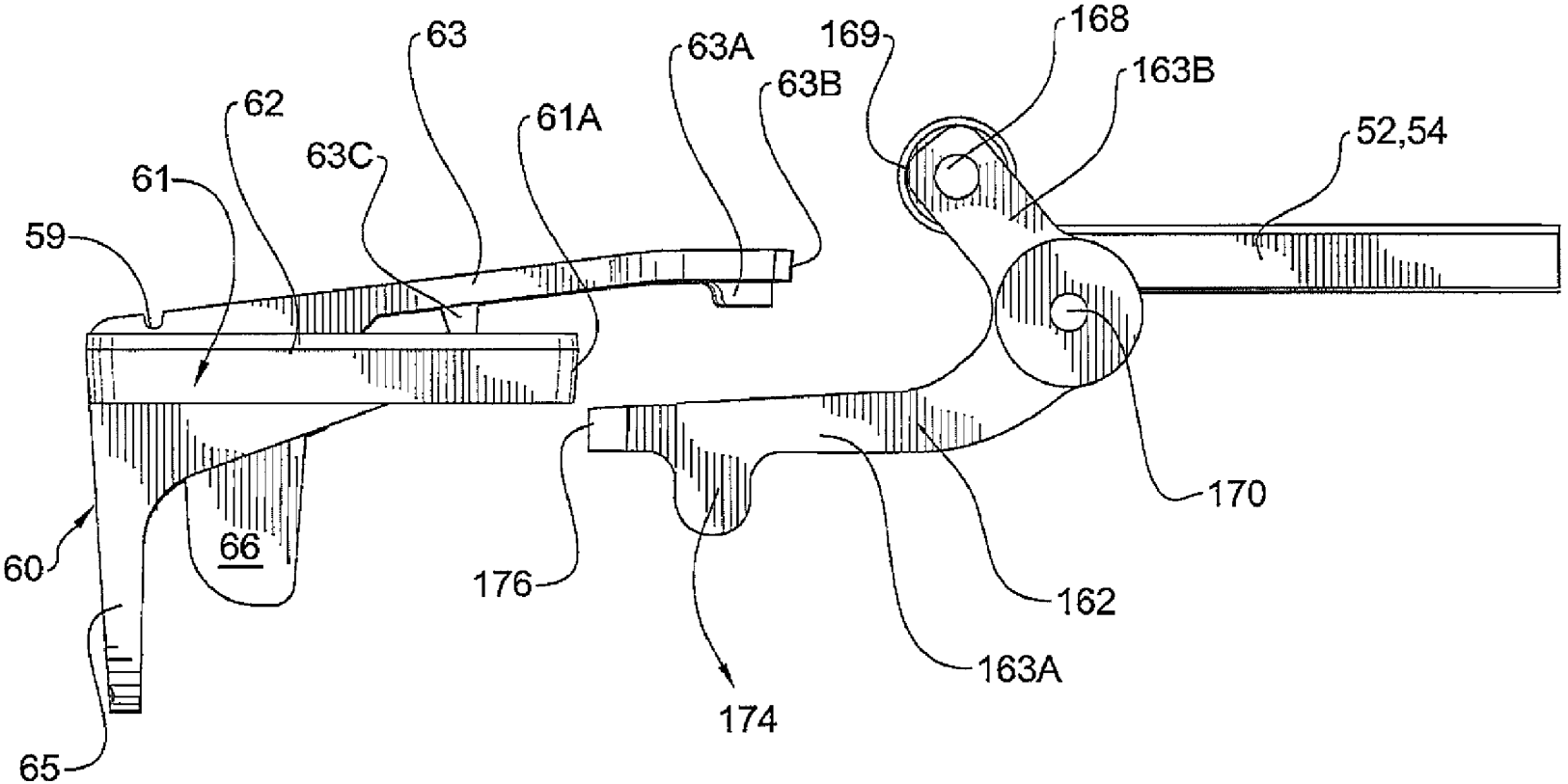
FIG. 17 is a view similar to FIG. 14 but with the pusher retention device in its inoperative condition corresponding to a greater fastener depletion so that the pusher retention device releases the fastener pusher and becomes partly downwardly tilted from its position of FIG. 14.

C. As shown in FIG. 17 for the third step of operation of the present embodiment of the invention, the strip of fasteners 52, 54, has become still more depleted from further repeated uses of the nailer, so that the strip of fasteners now also come to clear the roller 169. Once this happens, pusher retention leg 162 is automatically brought into counterclockwise pivotal motion about pivotal axle 170 away from pusher head 63A, thus clearing abutment end 176 of leg 163 from front seat 61A of pusher member 60. This automatic pivotal motion of pusher retention lever 162 about pivot 170 is induced by the spring recoil band 400 (that continuously apply a pulling bias onto pusher member 60 toward spool 402) and by a resultant angular torque generated at pivot mount 170 from angular momentum produced between the vector of force of the recoil band 400 pull onto pusher member slide base 62 and the plane intersecting the slide base 62 and the pivotal axle 170.

D. From now on, pusher member 60 will be able move toward spool 402 yieldingly to the pulling action of spring recoil band 400, leg 176 has released stopper 61A, and the pusher head leading edge 63B will come to abut against the registering trailing fastener 52A of the fasteners strip 52, 54. Pusher member 60 will then substantially replace gravity feed as a means of pushing the fasteners toward the fastener discharge end portion 522 of the fastener magazine 42.

Figure 19:
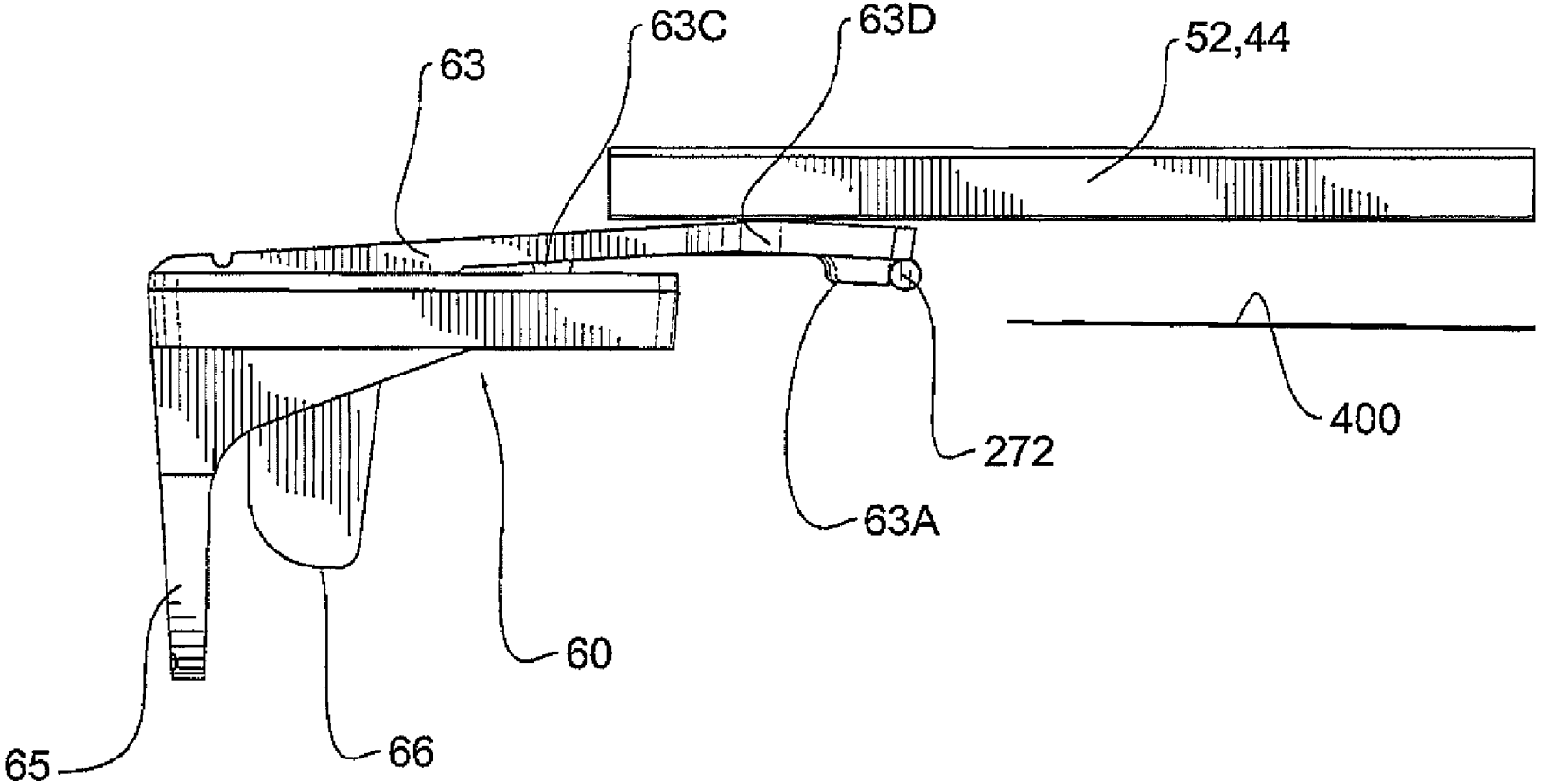
FIG. 19 is similar to FIG. 11, but showing the second embodiment of releasable pusher retention device of FIG. 18 for controlled action feeder magazine, with the spring loaded recoil band and fasteners strip shown in edge view, wherein the pusher retention device is in its pusher retaining state.
Figure 20:
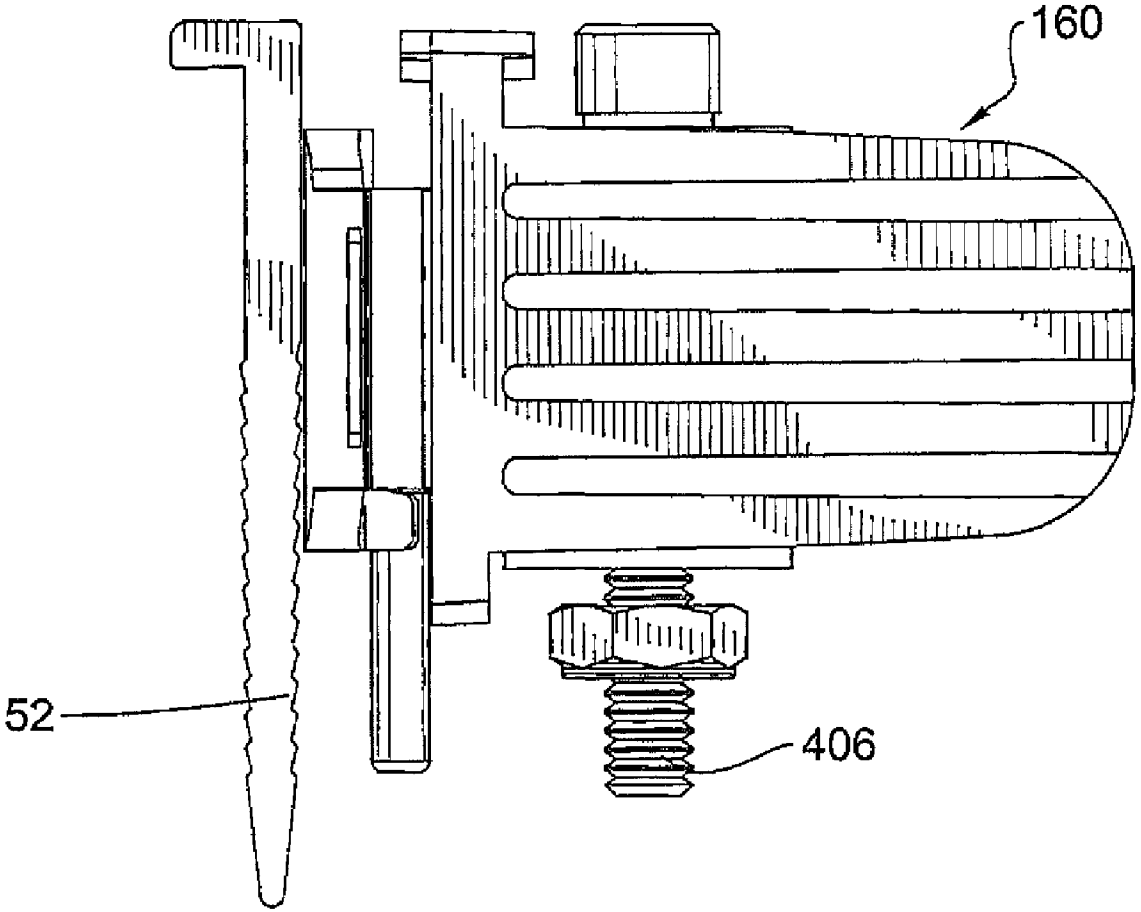
FIG. 20 is an end view similar to FIG. 13, but for the second embodiment of pusher retention device.
Figure 21:
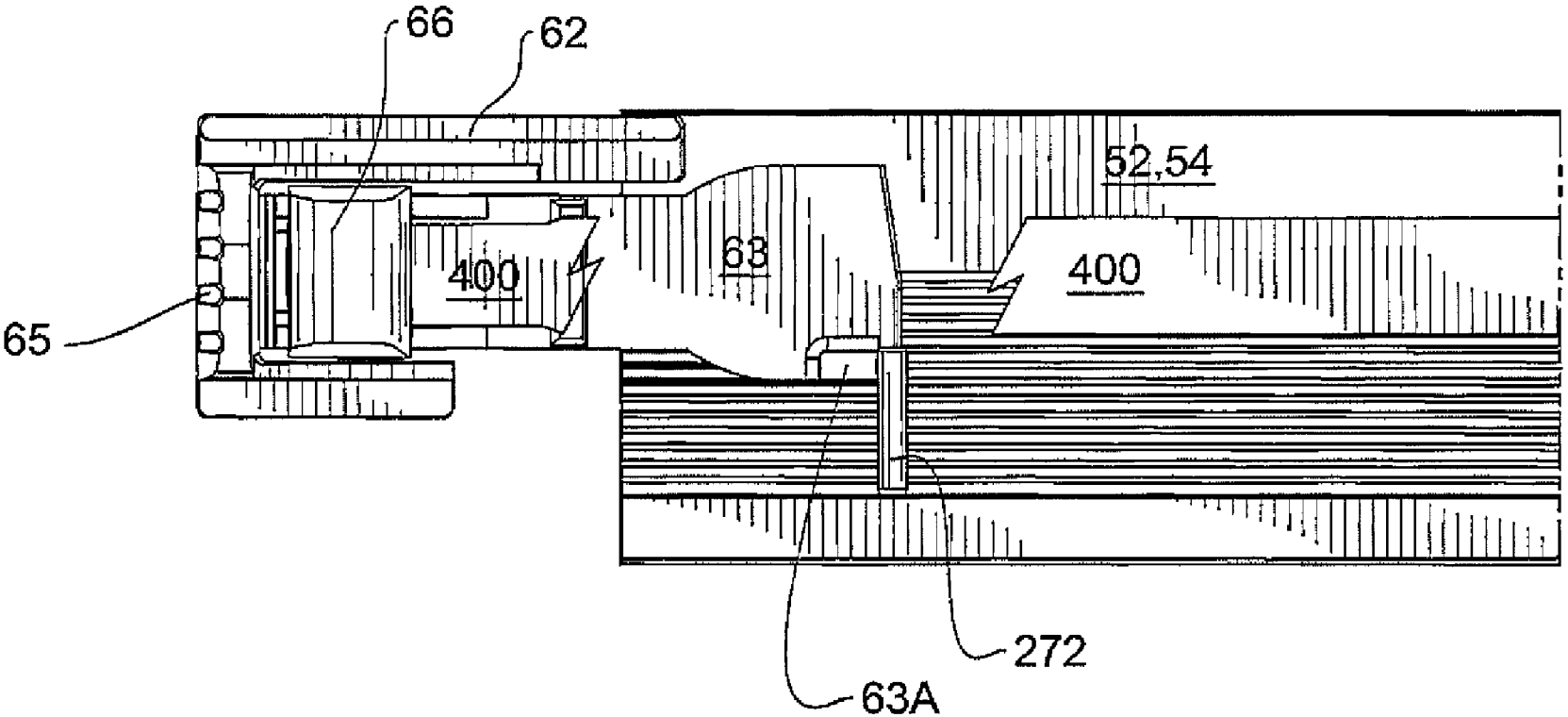
FIG. 21 is a top plan view of the components of FIG. 19.

In a second embodiment of the pusher member and pusher retention device assembly for controlled action of lower feeder magazine 42, shown in FIGS. 18 to 24 of the drawings, the inner magazine frame 42 is modified by adding an ear 272 integrally projecting from magazine side wall 514 and oriented toward wall 512, but extending well short thereof. Ear 272 is sized and positioned for releasable engaging abutment by ear 63A of pusher leg 63. In operation:

A. as illustrated in FIG. 19, with a full load of fasteners 52, 54, the free outer end portion 63D of pusher leg 63 is offset from the plane of fasteners 52, 54, and abuts flatly against the underlying surface of fastener strip 52, 54. Pusher ear 63A abuts against transverse pusher retention ear 272, so that pusher member 60 remains stationary at the fastener intake end portion 520 of the magazine 42 against the pulling bias of recoil band 400, since ear 272 is integral to side wall 514 of magazine frame 42.

Figure 22:
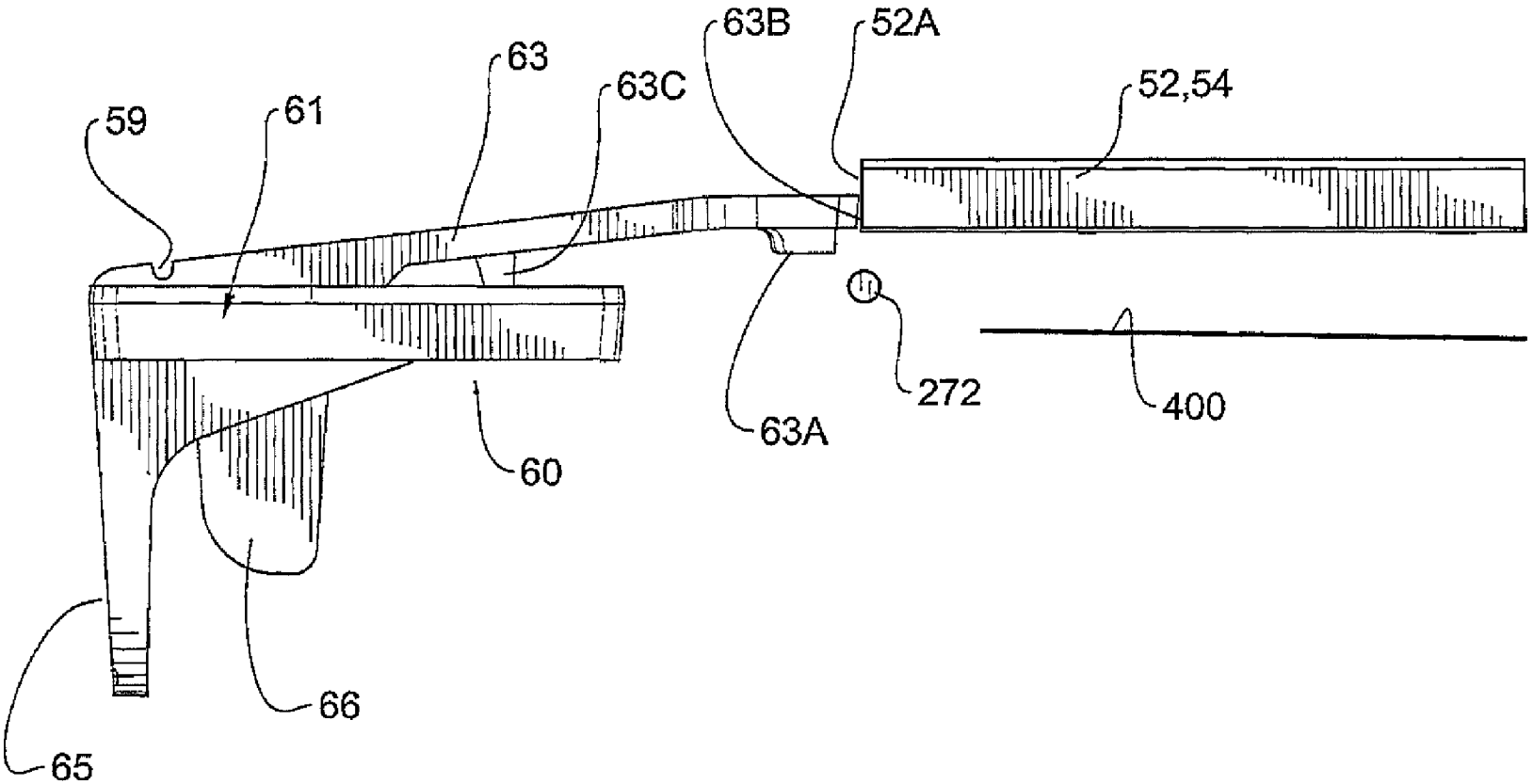
FIG. 22 is an elevational view similar to FIG. 19, but with the fastener strip being partly depleted so that the pusher head has tilted outwardly to come in coplanar register with the fasteners strip and the pusher retention device has released the pusher so that the pusher retention device has become in its inoperative mode.
Figure 23:
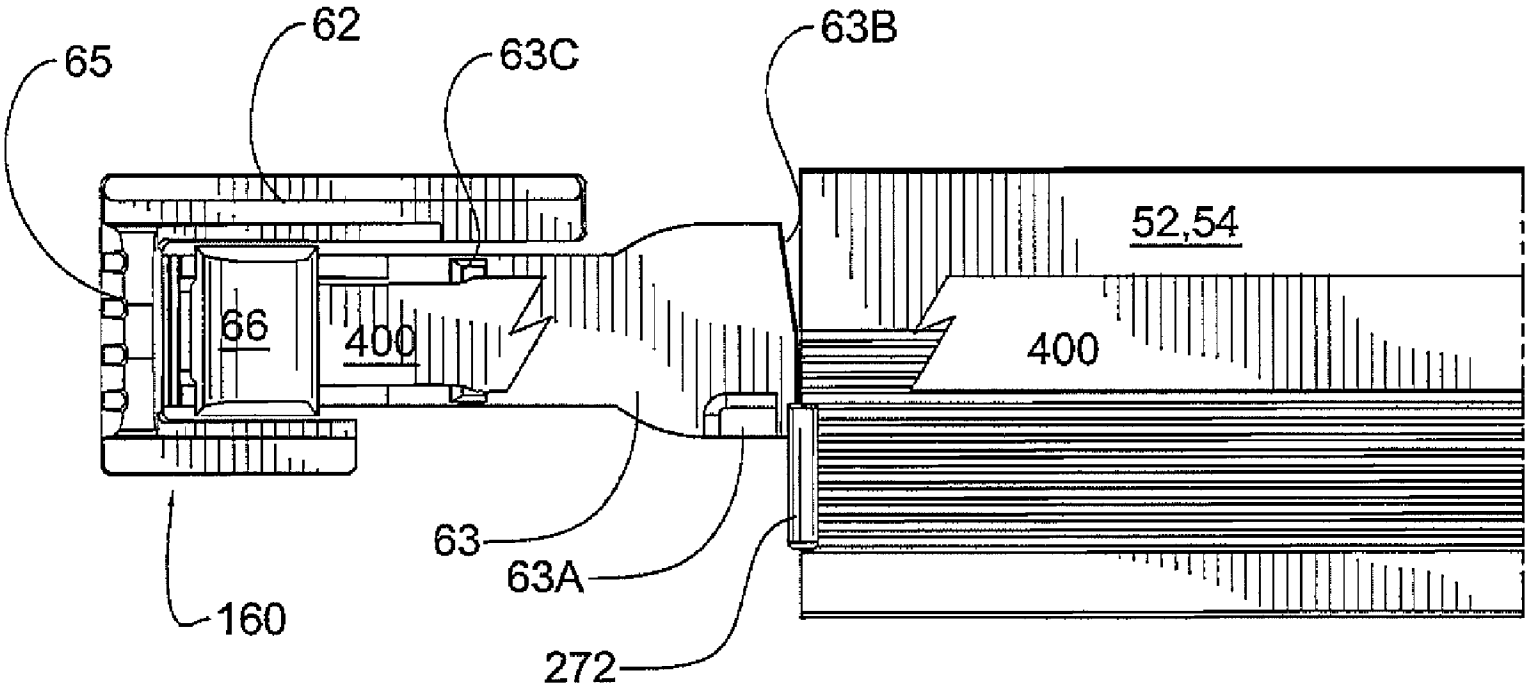
FIG. 23 is a top plan view of the components of FIG. 22.
Figure 24:
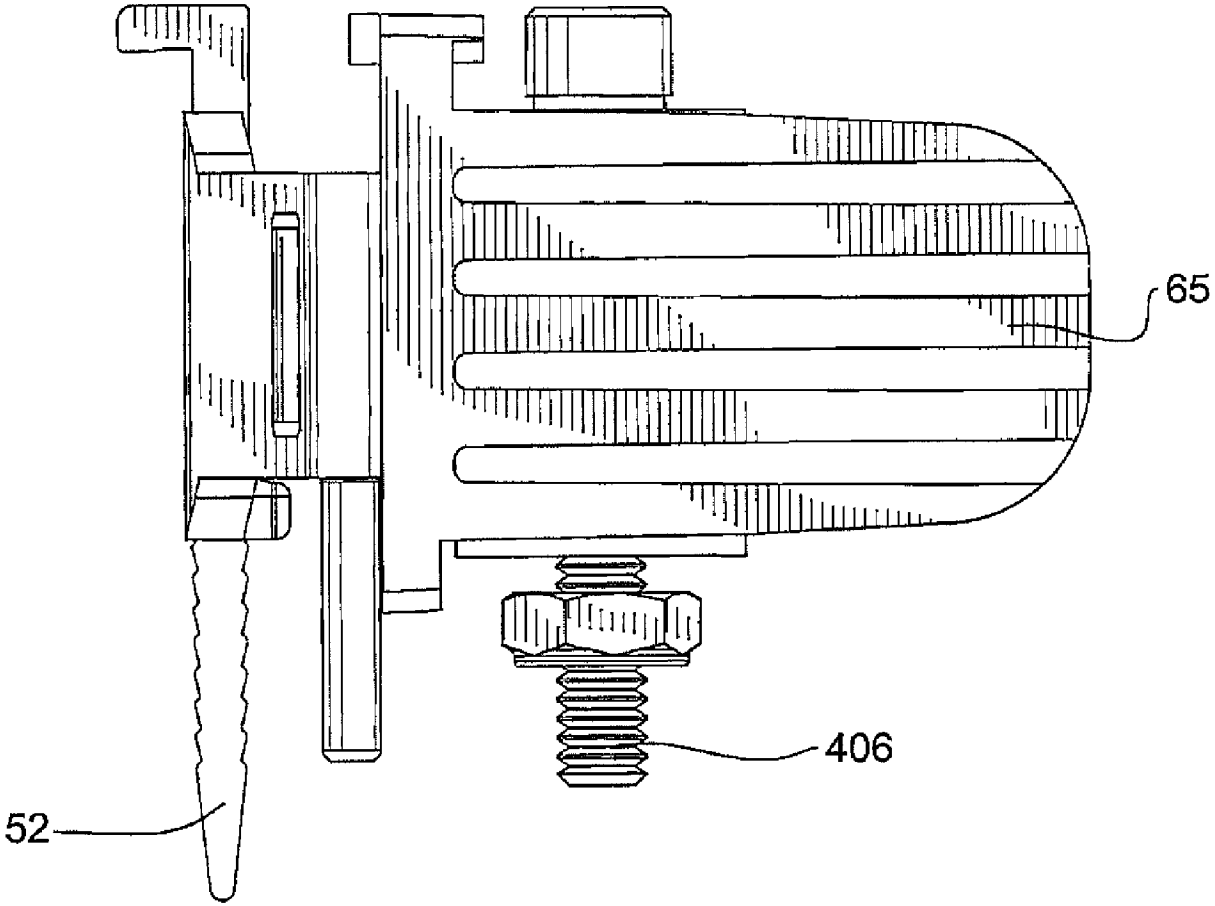
FIG. 24 is an end view similar to FIG. 20, but at the inoperative pusher retention device mode of FIG. 22.

B. As illustrated in FIG. 22, once the fastener load has been partly depleted, pusher arm 63 will tilt downwardly toward magazine flooring 510, so that its outer free end edge 63B comes in coplanar register with the trailing fastener 52A of the fastener strip 52, 54. Such tilting motion of pusher leg 63 is enabled by release of the interlock abutment between ears 63A and 272, and by the bending moment brought about onto resilient pusher leg 63 by the constant pulling action of recoil blade 400 against shoulder 63C of pusher leg 63.

C. From now on, recoil blade 400 effectively induces motion of pusher member 60, to which it is connected at 66, for sliding movement toward spool 402 at the fastener discharge end 522 of magazine 42.

FIGS. 25 to 28 show a third and most preferred embodiment of pusher member and pusher retention device assembly for controlled action of lower feeder magazine 42. An elongated rigid rectangular tab 307 is endwisely pivotally mounted at pivot mount to magazine U-frame side walls 512, 514, and extending therebetween, at the fastener intake end portion 520 of inner magazine 42. Tab 307 is generally flat, preferably metallic, and includes an intermediate transversely projecting ear 306. Tab 307 generally extends through magazine gap 530 (FIG. 7), i.e. within a plane intermediate pusher member channel 512A, 514A, and fastener slide-through channel 518. However, the inner end portion 307A of blade, facing spool 402, may tilt downwardly toward magazine flooring 510, when tab 307 is pivoted about pivot mount 310. Fastener pusher member 60' further includes a cavity 280 made on leg 63 and sized and positioned for releasable engagement by tab ear 306. In operation:

A. referring to FIG. 25, with a full load of fasteners 52, 54, pusher member 60' is fully extended away from spool 402 and lays flat against tab 307, which itself lays flat at its outer end portion 307A against underlying fasteners 52, 54. Pusher leg 63 is offset from the plane of fasteners 52, 54, and is maintained generally parallel to tab 307 and fastener strips 52, 54; and ear 306 is lockingly engaged into cavity 280, thus interlocking tab 307 (and associated magazine main frame 42) with pusher member 60'.

Figure 27:
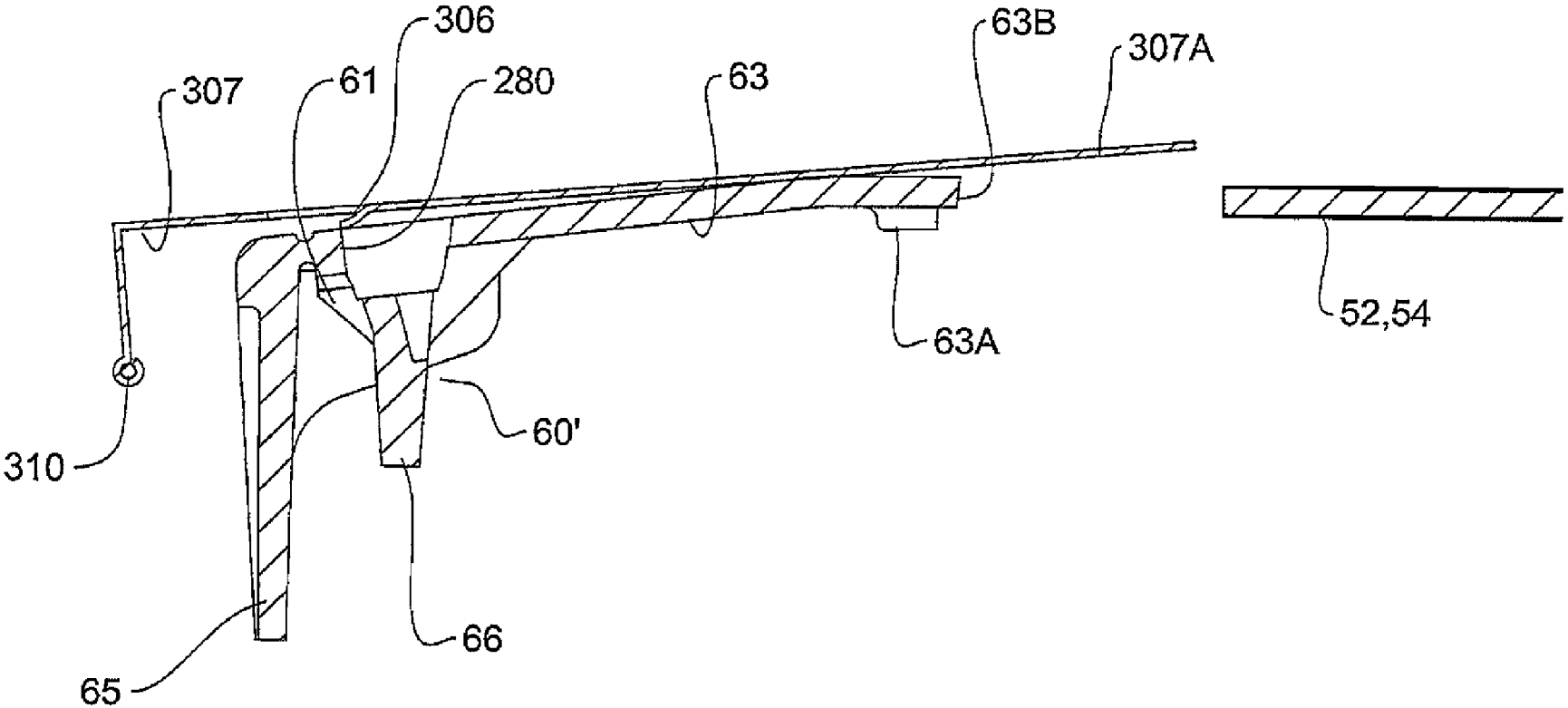
FIGS. 27 and 28 are views similar to that of FIG. 25, but suggesting how progressive fasteners depletion from the fastener strip enables deactivation of the pusher retention device and corresponding release of the pusher head from the strip of fasteners.

B. Referring to FIG. 27, once the fastener load has been sufficiently partly depleted, tab end portion 307A clears fasteners strip 52, 54, and thus is allowed to tilt toward magazine flooring 510 under bias from overlying tilt action of pusher leg 63 as already explained hereinabove, wherein ear 306 releases cavity 280 so that pusher member 60' becomes free to move relative to tab 307.

Figure 28:
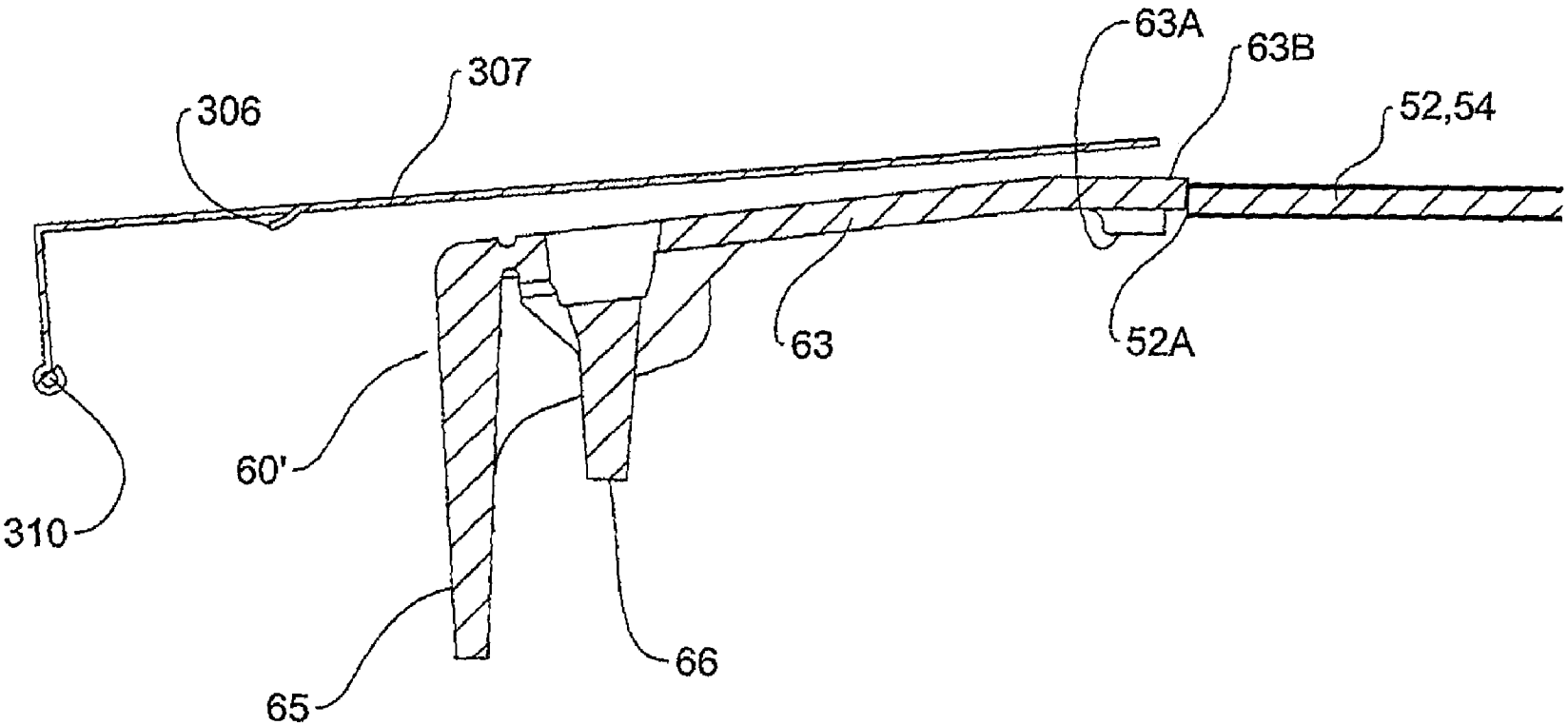

C. Referring to FIG. 28, once this occurs, the pusher member 60' will move toward spool 402 yieldingly to the action of the spring biased recoil band 400 to which it is constantly attached, as already explained which will bring pusher leg 63 coplanar to fastener strip 52 or 54, to abut at its outer free end 63B against the facing edge 52A of the trailing fastener from fastener strip 52, 54.

It is noted that this third and last embodiment of the invention of FIGS. 25-28 has been deemed to be the best performing embodiment of the three, because of optimal stability and operational integrity in its operation, including best dynamic performance.

The tab 307 should be made from a material that will be wear resistant to shearing action borne from slidethrough passage of underlying metallic fasteners 52, 54; preferably, this material will be a metallic material. It is also noted that the pusher member 60' is usually made from plastic or other semi-soft material, so that tab 307 sandwiched between pusher member 60' and metallic fasteners 52, 54, will shield the latter from the structural damage that would result from repeated direct engagement shearing action from the passing metallic fasteners 52, 54, were it not for the intermediate presence of tab 307.

The present invention is therefore directed to a nailer, with a nail feeder magazine which can be elbowed or straight. A fastener pusher having an operative mode and an inoperative mode, is provided. Three (3) different embodiments of retention systems for temporarily maintaining the fastener pusher in inoperative mode, are disclosed herein. However, other embodiments of such temporary retention systems for fastener pushers are not excluded from the scope of the present invention.

The general object of the present invention is to increase the fastener capacity or load inside the nailer magazine, without requiring an increase in the overall nailer frame size. The elbowed configuration of the magazine, and/or the two modes (operative/inoperative) of the pusher retention system, provide for this increase in magazine fastener capacity without corresponding increase in required operational clearance ahead of the nailer.

We claim:

1. A controlled action feeder magazine assembly for feeding a strip of multiple fasteners into a pneumatic nailer, said pneumatic nailer having a main frame with a fastener discharge outlet to which said magazine assembly is to be mounted, said magazine assembly having an elongated inner frame segment to be fixedly mounted to said main frame, an elongated outer frame segment, and coupling means operatively connecting in non-coaxial fashion said inner frame segment and said outer frame segment in an elbowed fashion for free slidethrough of said strip of multiple fasteners, each of said inner frame segment and said outer frame segment having a corresponding first and second channels for slidingly retaining fasteners in slidethrough fashion, said fasteners movable under gravity forces through said channels from a fastener intake means to a fastener discharge means thereof opposite said fastener intake means; and further including a spring biased fastener pusher means, carried inside said inner frame segment, said fastener pusher means for forcibly biasing said fasteners toward said fastener discharge means, and a pusher means retention means, said retention means having an operative mode, active with a large storage load of fasteners into said channel of said inner frame segment, and an inoperative mode, triggered when said load of fasteners in said inner frame segment decreases below a threshold value.

2. The controlled action feeder magazine assembly as in claim 1, wherein said fastener pusher means includes a carriage slidably carried into said inner frame segment with said carriage including a notch and said retention means includes an elongated rigid lock tab endwisely pivotally mounted at an intermediate first pivot mount to said inner frame segment at said fastener intake means, wherein one and another tab end portions are defined on opposite sides of said first pivot mount, said another tab end portion including an intermediate transversely projecting ear releasably engaged into said notch in said fastener pusher means operative mode; and said ear disengaged from said notch in said fastener pusher means inoperative mode, said inoperative mode being induced by fastener depletion-based tilt release of said another tab end portion about said first pivot mount.

3. The controlled action feeder magazine assembly as in claim 2, wherein said lock tab is made from a metallic material.

4. The controlled action feeder magazine assembly as in claim 1, wherein said fastener pusher means includes a carriage slidably carried into said inner frame segment and having a transverse leg, and said retention means includes an ear integrally projecting from opposite side walls defined by said channel within said inner frame segment, said ear releasably abutting against said carriage-transverse leg in said operative mode of said retention means, and said ear disengaging said carriage transverse leg in said operative mode thereof; said inoperative mode being induced by fastener depletion-based release of said transverse leg from said ear.

5. The controlled action feeder magazine assembly as in claim 1, wherein said fastener pusher means includes a carriage slidably carried into said inner frame segment and defining a frame seat, said retention means including an arcuate retention lever having first and second opposite legs, said first leg having an elbowed free end portion releasably abutting against said frame seat in said operative mode of said retention means and releasing said frame seat in said inoperative mode thereof, said arcuate retention lever extending on an exterior side of said inner frame segment except for said elbowed free end portion of said first leg which extends transversely through an intermediate section of a side wall defined by said inner frame segment, a pivotal axle also mounted exteriorly of said inner frame segment and rotatably journalled thereto and pivotally mounting an intermediate elbow apex of said arcuate retention lever to said inner frame segment, a roller pivotally mounted to said second leg, said roller for rollingly releasable engagement with a top edge side of said strip of multiple fasteners in said operative mode of said retention means, and clearing said top edge side of said strip of multiple fasteners in said inoperative mode of said retention means under fastener depletion-based counterclockwise rotation of said arcuate retention lever about said pivotal axle thereof.

6. A pneumatic nailer having a main frame and a fastener discharge outlet, an elbowed feeder magazine assembly for feeding a strip of multiple fasteners into said pneumatic nailer in controlled action fashion, said magazine assembly having an elongated inner frame segment fixedly mounted to said main frame, an elongated outer frame segment, and coupling means operatively connecting in non-coaxial fashion said inner frame segment and said outer frame segment for free slidethrough of said strip of multiple fasteners, each of said inner frame segment and said outer frame segment having a corresponding first and second channels for slidingly retaining fasteners in slidethrough fashion, said fasteners movable under gravity forces through said channels from a fastener intake means to a fastener discharge means coextensive to said fastener discharge outlet and opposite said fastener intake means; and further including a spring biased fastener pusher means, carried inside said inner frame segment, said fastener pusher means for forcibly biasing said fasteners toward said fastener discharge means; and a pusher means retention means, said retention means having an operative mode, active with a large storage load of fasteners into said channel of said inner frame segment, and an inoperative mode, triggered when said load of fasteners in said inner frame segment decreases below a threshold value.

7. The pneumatic nailer as in claim 6, wherein said outer frame segment extends generally in upright condition in an operative condition of said pneumatic nailer.

8. The pneumatic nailer as in claim 7, wherein said outer flame segment is further releasably anchored by an attachment bracket to said main frame adjacent a top nailer handle, wherein said magazine assembly closely matches an external contour of said pneumatic nailer.

9. A controlled action feeder magazine assembly for feeding a strip of multiple fasteners into a pneumatic nailer, said pneumatic nailer having a main frame with a fastener discharge outlet to which said feeder magazine assembly is to be mounted, said feeder magazine assembly including a channel member to be fixedly mounted to said main frame for free slidethrough of said strip of multiple fasteners and for slidingly retaining fasteners in slidethrough fashion, said fasteners movable under gravity forces through said channel member from a fastener intake means thereof to a fastener discharge means thereof opposite said fastener intake means; a spring biased fastener pusher means carried inside said channel member, said fastener pusher means for forcibly biasing said fasteners toward said fastener discharge means, and a pusher means retention means, said retention means having an operative mode, active with a large storage load of fasteners into said channel member, and an inoperative mode, triggered when said load of fasteners in said channel member decreases below a threshold value.

10. The controlled action feeder magazine assembly as in claim 9, wherein said fastener pusher means includes a carriage slidably carried into said channel member with said carriage including a notch and said retention means including an elongated rigid lock tab endwisely pivotally mounted at an intermediate first pivot mount to said channel member at said fastener intake means, wherein one and another tab end portions are defined on opposite sides of said first pivot mount, said another tab end portion including an intermediate transversely projecting ear releasably engaged into said notch in said fastener pusher means operative mode; and said ear disengaged from said notch in said fastener pusher means inoperative mode, said inoperative mode being induced by fastener depletion-based tilt release of said another tab end portion about said first pivot mount.

11. The controlled action feeder magazine assembly as in claim 10, wherein said lock tab is made from a metallic material.

12. The controlled action feeder magazine assembly as in claim 9, wherein said fastener pusher means includes a carriage slidably carried into said channel member and having a transverse leg, and said retention means includes an ear integrally projecting from opposite side walls defined by said channel members therewithin, said ear releasably abutting against said transverse leg in said operative mode of said retention means, and said ear disengaging said carriage transverse leg in said inoperative mode thereof, said inoperative mode being induced by fastener depletion-based release of said transverse leg from said ear.

13. The controlled action feeder magazine assembly as in claim 9, wherein said fastener pusher means includes a carriage slidably carried into said channel member and defining a frame seat, said retention means including an arcuate retention lever having first and second opposite legs, said first leg having an elbowed free end portion releasably abutting against said frame seat in said operative mode of said retention means and releasing said frame seat in said inoperative mode thereof, said arcuate retention lever extending on an exterior side of said channel member except for said elbowed free end portion of said first leg which extends transversely through an intermediate section of a side wall defined by said channel member, a pivotal axle also mounted exteriorly of said channel member and rotatably journaled thereto and pivotally mounting an intermediate elbow apex of said arcuate retention lever to said channel member, a roller pivotally mounted to said second leg, said roller for rollingly releasable engagement with a top edge side of said strip of multiple fasteners in said operative mode of said retention means, and clearing said top edge side of said strip of multiple fasteners in said inoperative mode of said retention means under fastener depletion-based counterclockwise rotation of said arcuate retention lever about said pivotal axle thereof.

* * * * *